US007163280B2

(12) United States Patent
Watanabe

(10) Patent No.: US 7,163,280 B2
(45) Date of Patent: Jan. 16, 2007

(54) INK-JET HEAD, AND INK-JET RECORDING APPARATUS INCLUDING THE INK-JET HEAD

(75) Inventor: Hidetoshi Watanabe, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 223 days.

(21) Appl. No.: 10/902,116

(22) Filed: Jul. 30, 2004

(65) Prior Publication Data

US 2005/0057613 A1 Mar. 17, 2005

(30) Foreign Application Priority Data

Aug. 11, 2003 (JP) ..... 2003-291277

(51) Int. Cl.
*B41J 2/045* (2006.01)

(52) U.S. Cl. ..... 347/68

(58) Field of Classification Search ..... 347/68–72; 29/25.35

See application file for complete search history.

(56) References Cited

U.S. PATENT DOCUMENTS 5,266,964 A * 11/1993 Takahashi et al. ..... 347/72
5,889,539 A * 3/1999 Kamoi et al. ..... 347/50
6,174,051 B1 * 1/2001 Sakaida ..... 347/72
6,190,006 B1 * 2/2001 Kurashima et al. ..... 347/70
6,364,468 B1 * 4/2002 Watanabe et al. ..... 347/68
6,540,313 B1 * 4/2003 Suzuki ..... 347/5
6,631,981 B1 10/2003 Isono et al.

FOREIGN PATENT DOCUMENTS

| | | |
|---|---|---|
| EP | 1 316 426 A1 | 6/2003 |
| EP | 1 336 488 A2 | 8/2003 |
| JP | 7-246701 A | 9/1995 |
| JP | 8-25628 A | 1/1996 |
| JP | A 2002-19102 | 1/2002 |

* cited by examiner

*Primary Examiner*—An H. Do
(74) *Attorney, Agent, or Firm*—Oliff & Berridge, PLC

(57) ABSTRACT

An ink-jet head includes a flow path unit in which an ink flow path is formed and plural actuator units bonded to an upper surface of the flow path unit. On the flow path unit, an adhesive is applied to an area not covered with the actuator unit. Individual electrodes are disposed on an upper surface of the actuator unit, and are electrically connected to a flexible printed circuit. The flexible printed circuit is fixed to the flow path unit by the adhesive. A recess as a stepped part is formed between the adhesive and the actuator unit and on a surface of the flow path unit at a side of the flexible printed circuit.

11 Claims, 16 Drawing Sheets

INK-JET HEAD, AND INK-JET RECORDING APPARATUS INCLUDING THE INK-JET HEAD

BACKGROUND OF THE INVENTION

1. Field of the Invention

The present invention relates to an ink-jet head for discharging ink to perform printing on a recording medium, and an ink-jet recording apparatus including this ink-jet head.

2. Description of the Related Art

In an ink-jet recording apparatus (ink-jet printer), an ink-jet head distributes ink supplied to a manifold from an ink tank to plural pressure chambers, and selectively applies pulse-like pressure to the respective pressure chambers so that the ink is discharged from nozzles. As means for selectively applying pressure to the pressure chambers, there is a case where an actuator unit is used in which plural piezoelectric sheets made of ceramic are laminated.

As an example of such an ink-jet head, there is one which includes an actuator unit including plural continuous flat plate piezoelectric sheets extending over plural pressure chambers (for example, see JP-A-2002-19102 (FIG. 1)). In this ink-jet head, between the plural laminated piezoelectric sheets of the actuator unit, there are arranged a common electrode common to the many pressure chambers and kept at the ground potential, and individual electrodes arranged at positions corresponding to the respective pressure chambers, that is, drive electrodes. Further, surface electrodes connected to the common electrode and the individual electrodes are formed on the upper surface of the uppermost piezoelectric sheet. A flexible printed circuit for electrically connecting the surface electrodes and a power supply part is disposed on the upper surface of the uppermost piezoelectric sheet. Accordingly, voltage is applied between the common electrode and the individual electrodes by the power supply part via the flexible printed circuit and the surface electrodes, so that distortion occurs in the piezoelectric sheets included in the actuator unit and ink is discharged.

SUMMARY OF THE INVENTION

In the ink-jet head disclosed in JP-A-2002-19102 (FIG. 1), there is a problem that the flexible printed circuit disposed on the piezoelectric sheet on which the surface electrodes are formed is applied with a force from the outside to peel off this, and when the flexible printed circuit is peeled off from the piezoelectric sheet, the electrical connection between the surface electrodes and the power supply part is broken.

It is an object to provide an ink-jet head in which a flexible printed circuit is not easily peeled off from an actuator unit and an ink-jet recording apparatus including this ink-jet head.

According to one aspect of the invention, an ink-jet head includes a flow path unit in which plural pressure chambers communicating with nozzles are arranged along a plane, an actuator unit which includes plural individual electrodes arranged at positions opposite to the pressure chambers, is fixed to one surface of the flow path unit and changes volumes of the pressure chambers, a flexible printed circuit in which plural signal lines for supplying drive signals to change the volumes of the pressure chambers to the individual electrodes are formed as a conductive pattern and the respective signal lines are electrically connected to the corresponding individual electrodes, an adhesive applied to an area not covered with the actuator unit on the one surface of the flow path unit and for fixing the flexible printed circuit to the flow path unit, and a stepped part formed between the actuator unit and the adhesive on the one surface of the flow path unit so that movement of the adhesive in a direction of approaching the actuator unit is blocked.

According to another aspect of the invention, an ink-jet head includes a flow path unit in which plural pressure chambers communicating with nozzles are arranged along a plane, an actuator unit which includes plural individual electrodes arranged at positions opposite to the pressure chambers, a common electrode provided to extend over the plural pressure chambers, and a piezoelectric sheet sandwiched between the common electrode and the individual electrodes, is fixed to one surface of the flow path unit and changes volumes of the pressure chambers, a flexible printed circuit in which plural signal lines for supplying drive signals to change the volumes of the pressure chambers to the individual electrodes are formed as a conductive pattern and the respective signal lines are electrically connected to the corresponding individual electrodes, an adhesive applied to an area not covered with the actuator unit on the one surface of the flow path unit and for fixing the flexible printed circuit to the flow path unit, and a stepped part formed between the actuator unit and the adhesive on the one surface of the flow path unit so that movement of the adhesive in a direction of approaching the actuator unit is blocked.

According to this, the flexible printed circuit is fixed to the flow path unit by not only the individual electrodes but also the adhesive, so that even if a force is applied from the outside to the flexible printed circuit to peel off this, the flexible printed circuit is not easily peeled off. Thus, it is possible to restrain the connection between the individual electrode and the flexible printed circuit from being broken. Besides, by means of the stepped part, it is possible to prevent the occurrence of malfunction of the actuator unit due to adhesion of the adhesive onto the actuator unit. Accordingly, it is possible to obtain the ink-jet head in which poor discharge of ink from the nozzle does not easily occur.

It is preferable that the stepped part is a recess formed in an area of the one surface of the flow path unit where the adhesive is not applied. By this, since the flexible printed circuit can be made to extend in parallel to the one surface of the flow path unit, adhesion between both is stabilized. Besides, working is relatively easy.

Besides, it is preferable that the stepped part is a protrusion formed in an area of the one surface of the flow path unit where the adhesive is not applied. By this, a height of the protrusion is made substantially coincident with a distance between the flow path unit and the flexible printed circuit at the individual electrode, so that the protrusion supports the flexible printed circuit, and therefore, adhesion between the flexible printed circuit and the flow path unit becomes very stable.

Besides, it is preferable that the stepped part is formed to surround the adhesive. By this, it is possible to prevent the adhesive from running over from the one surface of the flow path unit and adhering to an ink discharge surface and the like.

Besides, according to another aspect of the invention, an ink-jet head includes a flow path unit in which plural pressure chambers communicating with nozzles are arranged along a plane, an actuator unit which includes plural individual electrodes arranged at positions opposite to the pressure chambers, is fixed to one surface of the flow path unit and changes volumes of the pressure chambers, a flexible printed circuit in which plural signal lines for supplying drive signals to change the volumes of the pressure chambers to the individual electrodes are formed as a conductive pattern and the respective signal lines are electrically connected to the corresponding individual electrodes, an adhesive applied to an area not covered with the actuator unit on the one surface of the flow path unit and for fixing the flexible printed circuit to the flow path unit. The flow path unit includes a stepped part for storing the adhesive in the area where the adhesive is applied.

Besides, according to another aspect of the invention, an ink-jet head includes a flow path unit in which plural pressure chambers communicating with nozzles are arranged along a plane, an actuator unit which includes plural individual electrodes arranged at positions opposite to the pressure chambers, a common electrode provided to extend over the plural pressure chambers, and a piezoelectric sheet sandwiched between the common electrode and the individual electrodes, is fixed to one surface of the flow path unit and changes volumes of the pressure chambers, a flexible printed circuit in which plural signal lines for supplying drive signals to change the volumes of the pressure chambers to the individual electrodes are formed as a conductive pattern and the respective signal lines are electrically connected to the corresponding individual electrodes, and an adhesive applied to an area not covered with the actuator unit on the one surface of the flow path unit and for fixing the flexible printed circuit to the flow path unit. The flow path unit includes a stepped part for storing the adhesive in the area where the adhesive is applied.

Besides, according to another aspect of the invention, an ink-jet recording apparatus includes an ink-jet head in which the individual electrodes and the pressure chambers are arranged in a matrix form, and the stepped part is continuously or discretely provided along one side of a group of the individual electrodes arranged in the matrix form. By this, it is possible to obtain the ink-jet recording apparatus in which the occurrence of malfunction of the actuator unit due to adhesion of the adhesive onto the actuator unit is prevented in a wide range.

Besides, it is preferable that the individual electrodes and the pressure chambers are arranged in the matrix form, and the stepped part is continuously or discretely provided at an edge part of the flow path unit in a direction intersecting with an extension direction of the flexible printed circuit. By this, it is possible to prevent the malfunction of the actuator unit due to the adhesion of the adhesive onto the actuator unit from occurring in a wide range.

Besides, according to another aspect of the invention, an ink-jet head includes a flow path unit having a rectangular outer shape in which trapezoidal pressure chamber groups, in each of which plural pressure chambers communicating with nozzles are adjacently arranged in a matrix form along a plane, are arranged in a staggered manner in a longitudinal direction while oblique sides of the pressure chamber groups overlap with each other in a width direction, plural actuator units each of which includes plural individual electrodes arranged at positions opposite to the pressure chambers constituting the pressure chamber group, a common electrode provided to extend over the plural pressure chambers, and a piezoelectric sheet sandwiched between the common electrode and the individual electrodes, is fixed correspondingly to a formation area of each of the pressure chamber groups, has a similar shape to each of the pressure chamber groups and changes volumes of the pressure chambers, flexible printed circuits in each of which signal lines for supplying drive signals to change the volumes of the pressure chambers to the individual electrodes in each of the actuator units are formed and the signal lines are electrically connected to the corresponding individual electrodes, an adhesive applied to an area which is an end of the plane of the flow path unit in an extension direction in which the flexible printed circuit is led out and is not covered with the actuator unit, for fixing the flexible printed circuit to the flow path unit, and recesses formed between a position of the actuator unit and an application position of the adhesive to fix the flexible printed circuit and for blocking movement of the adhesive in a direction of approaching the actuator unit. Then, the flexible printed circuits correspond to the actuator units fixed to the flow path unit, and are led out alternately in opposite directions with respect to a longitudinal direction of the flow path unit, and at the end of the flow path unit in the extension direction in which the flexible printed circuit is led out, the plural recesses each formed to surround the adhesive are discretely provided in a direction intersecting with the extension direction. By this, it is possible to prevent malfunction of the actuator unit due to adhesion of the adhesive onto the actuator unit in a wide range, and it is possible to prevent the adhesive from running over from one surface of the flow path unit and adhering to an ink discharge surface and the like.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Hereinafter, preferred embodiments of the invention will be described with reference to the drawings.

Figure 1:
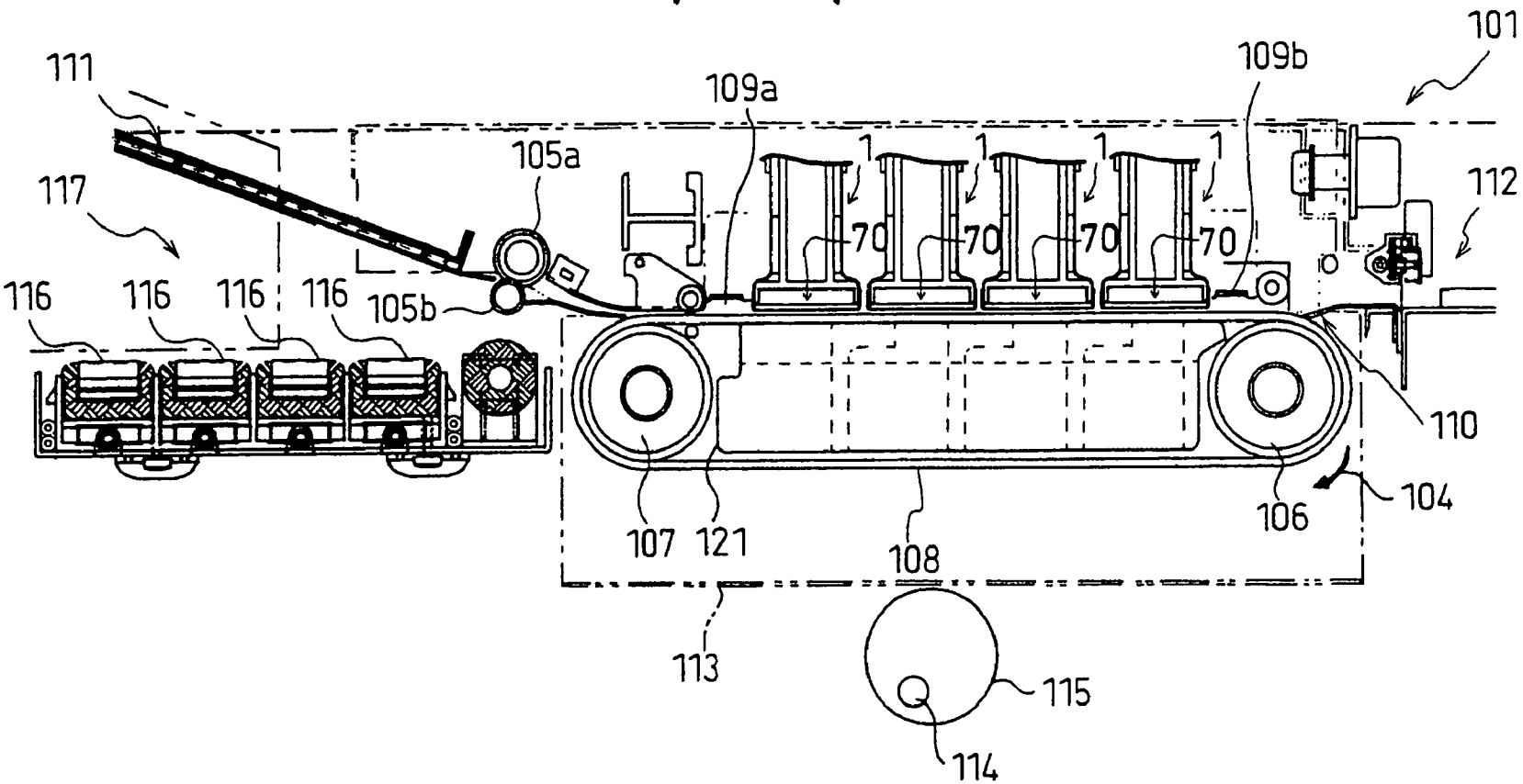
FIG. 1 is a schematic view of an ink-jet printer including an ink-jet head according to a first embodiment of the invention.

FIG. 1 is a schematic view of an ink-jet printer including an ink-jet head according to a first embodiment of the invention. An ink-jet printer 101 shown in FIG. 1 is a color ink-jet printer having four ink-jet heads 1. In this printer 101, a paper feeding part 111 is provided on the left of the drawing, and a paper ejecting part 112 is provided on the right of the drawing.

A sheet transport passage in which a sheet is transported from the paper feeding part 111 to the paper ejecting 112 is formed in the inside of the printer 101. A pair of feed rollers 105*a* and 105*b* for nipping and transporting the sheet as an image recording medium are arranged at an immediately downstream side of the paper feeding part 111. The sheet is sent by the pair of feed rollers 105*a* and 105*b* from the left to the right in the drawing. Two belt rollers 106 and 107 and an endless transport belt 108 wound between both the rollers 106 and 107 so as to be stretched are arranged at an intermediate portion of the sheet transport passage. The outer peripheral surface of the transport belt 108, that is, the transport surface is subjected to a silicon processing, and while the sheet transported by the pair of feed rollers 105*a* and 105*b* is held on the transport surface of the transport belt 108 by its adhesive force, it can be transported to the downstream side (right) by the rotation driving of the one belt roller 106 in the clockwise direction (direction of an arrow 104) in the drawing.

Press members 109*a* and 109*b* are respectively arranged at insertion and ejection positions of the sheet with respect to the belt roller 106. The press members 109*a* and 109*b* are for pressing the sheet to the transport surface of the transport belt 108 so that it is certainly adhered onto the transport surface.

A peeling mechanism 110 is provided at an immediately downstream side of the transport belt 108 along the sheet transport passage. The peeling mechanism 110 is constructed to peel off the sheet adhered to the transport surface of the transport belt 108 from the transport surface, and sends it to the right paper ejecting part 112.

The four ink-jet heads 1 include head main bodies 70 at their lower ends. The respective head main bodies 70 have rectangular sections, and are arranged to be close to each other so that a longitudinal direction of each of them becomes a direction (direction vertical to the paper surface of FIG. 1) vertical to a sheet transport direction. That is, this printer 101 is a line-type printer. Each of bottom surfaces of the four head main bodies 70 is opposite to the sheet transport passage, and many nozzles 8 (see FIG. 7) having minute diameters are provided on the bottom surface. Inks of magenta, yellow, cyan and black are discharged from the respective four head main bodies 70.

The head main body 70 is disposed so that a small gap is formed between its lower surface and the transport surface of the transport belt 108, and the sheet transport passage is formed in the gap portion. In this structure, when the sheet transported on the transport belt 108 passes through immediately under the four head main bodies 70 in sequence, the inks of the respective colors are discharged from the nozzles to the upper surface of the sheet, that is, the printing surface, so that a desired color image can be formed on the sheet.

The ink-jet printer 101 includes a maintenance unit 117 for automatically performing maintenance on the ink-jet heads 1. The maintenance unit 117 is provided with four caps 116 for covering the lower surfaces of the four head main bodies 70, a not-shown purge mechanism and the like.

When printing is performed in the ink-jet printer 101, the maintenance unit 117 is located at a position (retracted position) just under the paper feeding part 111. When a predetermined condition is satisfied after the end of the printing (for example, when a state in which the printing operation is not performed continues for a predetermined time, or when a power-off operation of the printer 101 is performed), it is moved to a position just under the four head main bodies 70, and covers the respective lower surfaces of the head main bodies 70 by the caps 116 at this position (cap position), so that drying of ink at the nozzle portions of the head main bodies 70 is prevented.

The belt rollers 106 and 107 and the transport belt 108 are supported by a chasse 113. The chasse 113 is put on a cylindrical member 115 disposed under it. The cylindrical member 115 is rotatable around a shaft 114 attached at a position away from its center. Thus, when the height of the upper end of the cylindrical member 115 is changed in accordance with the rotation of the shaft 114, the chasse 113 rises and falls in accordance with that. When the maintenance unit 117 is moved from the retracted position to the cap position, it is necessary that the cylindrical member 115 is previously rotated by a suitable angle to lower the chasse 113, the transport belt 108, and the belt rollers 106 and 107 from the position shown in FIG. 1 by a suitable distance, and a space for movement of the maintenance unit 117 is ensured.

In an area surrounded by the transport belt 108, there is disposed a guide 121 of a substantially rectangular parallelepiped (having a width comparable to the transport belt 108) which comes in contact with the lower surface of the transport belt 108 at a position opposite to the ink-jet head 1, that is, at the upper side and supports it from the inner peripheral side.

Figure 2:
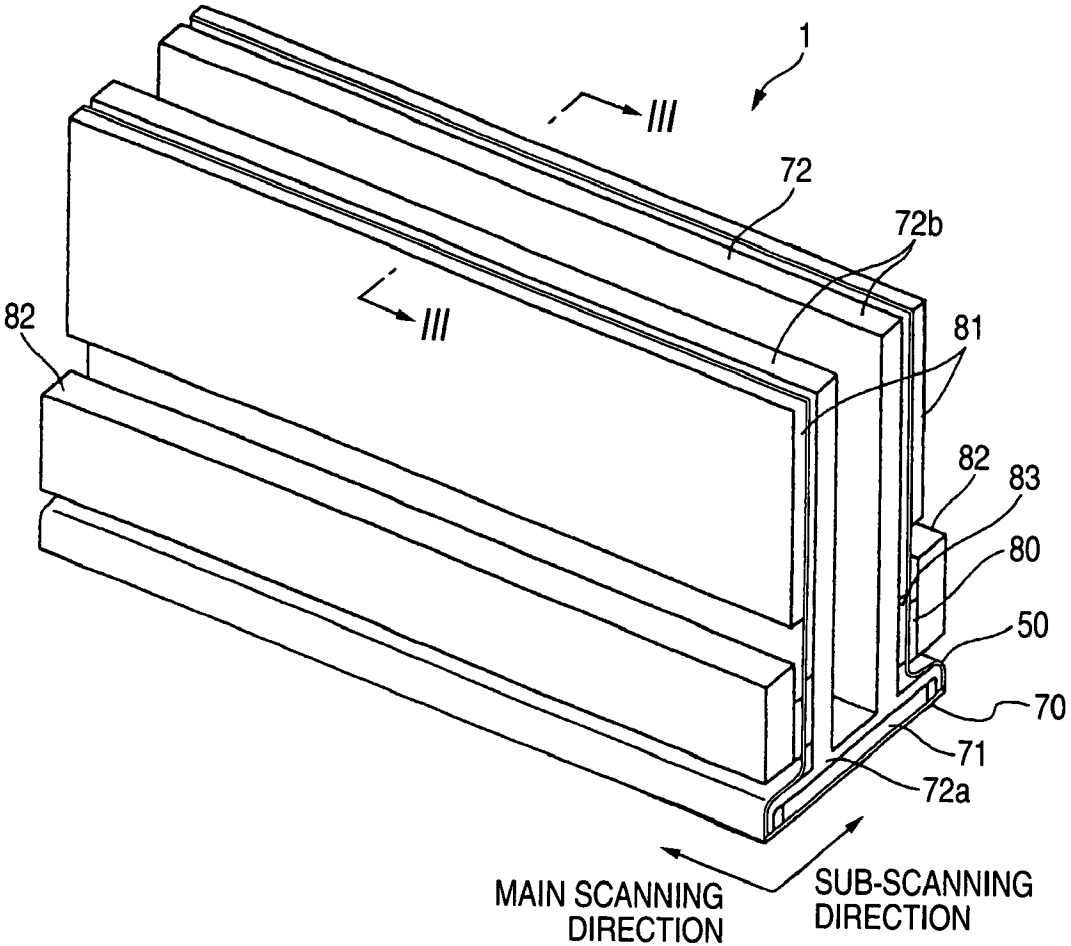
FIG. 2 is an outer appearance perspective view of the ink-jet head shown in FIG. 1.
Figure 3:
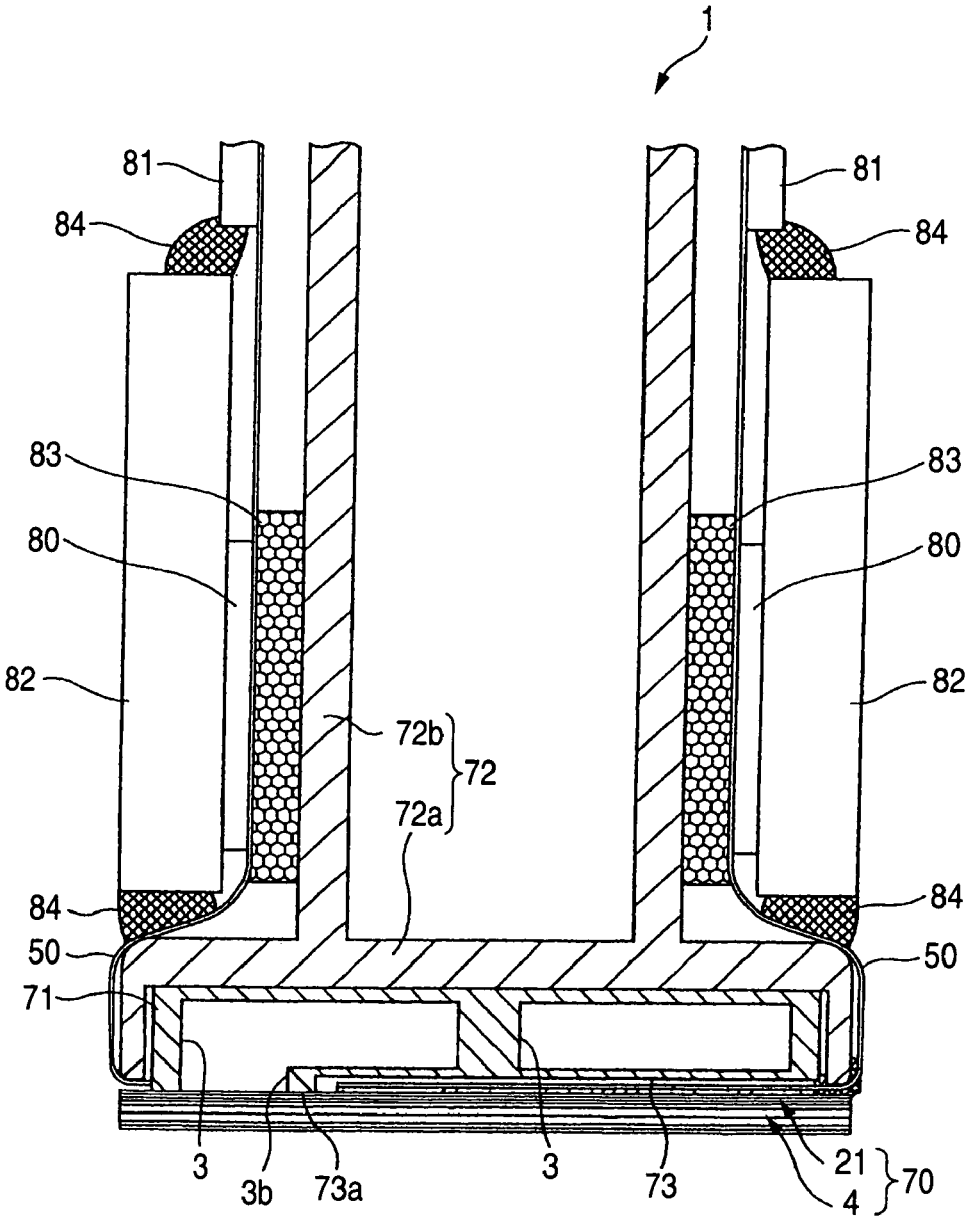
FIG. 3 is a sectional view taken along line III—III of FIG. 2.

FIG. 2 is an outer appearance perspective view of the ink-jet head shown in FIG. 1. FIG. 3 is a sectional view taken along line III—III of FIG. 2. The ink-jet head 1 includes the head main body 70 for discharging ink to the sheet and having a rectangular plane shape extending in a main scanning direction, and a base block 71 which is disposed above the head main body 70 and in which two ink reservoirs 3 as flow paths of ink supplied to the head main body 70 are formed.

The head main body 70 includes a flow path unit 4 in which an ink flow path is formed, and plural actuator units 21 adhered to the upper surface of the flow path unit 4. Both the flow path unit 4 and the actuator unit 21 are constructed such that plural sheet-like members are laminated and are mutually adhered to each other. A flexible printed circuit (FPC) 50 as a feeding member is adhered to the upper surface of the actuator unit 21, and the FPC 50 is led out toward the above in FIG. 3 while being bent. The base block 71 is made of, for example, metal material such as stainless.

The ink reservoir 3 in the base block 71 is a hollow area of substantially a rectangular parallelepiped formed in the longitudinal direction of the base block 71. The FPC 50 includes plural signal lines (not shown) formed as a conductor pattern.

A lower surface 73 of the base block 71 protrudes downward from a surrounding area in the vicinity of an opening 3*b*. The base block 71 is in contact with the flow path unit 4 only at a portion 73*a* near the opening 3*b* of the lower surface 73. Thus, an area other than the portion 73*a* near the opening 3*b* of the lower surface 73 of the base block 71 is separate from the head main body 70, and the actuator unit 21 is disposed in this separate portion.

The base block 71 is adhered and fixed to a recess formed in the lower surface of a grip part 72*a* of a holder 72. The holder 72 includes the grip part 72*a* and a pair of protrusions 72*b* extending from the upper surface of the grip part 72*a* in a direction orthogonal to this and spaced from each other by a predetermined interval. The FPC 50 adhered to the actuator unit 21 is arranged along the surface of each of the projections 72*b* of the holder 72 through an elastic member 83 such as a sponge. A driver IC 80 is disposed on the FPC 50 arranged on the surface of the projection 72*b* of the holder 72. In order to send a drive signal outputted from the driver IC 80 to the actuator unit 21 (described later in detail) of the head main body 70, the FPC 50 is electrically connected to both by soldering.

Since a heat sink 82 of substantially a rectangular parallelepiped is disposed to be in close contact with the outer surface of the driver IC 80, heat generated by the driver IC 80 can be efficiently dissipated. A board 81 is disposed above the driver IC 80 and the heat sink 82 and outside the FPC 50. Seal members 84 are respectively disposed between the upper surface of the heat sink 82 and the board 81, and between the lower surface of the heat sink 82 and the FC 50, and they are adhered to each other by those seal members 84.

Figure 4:
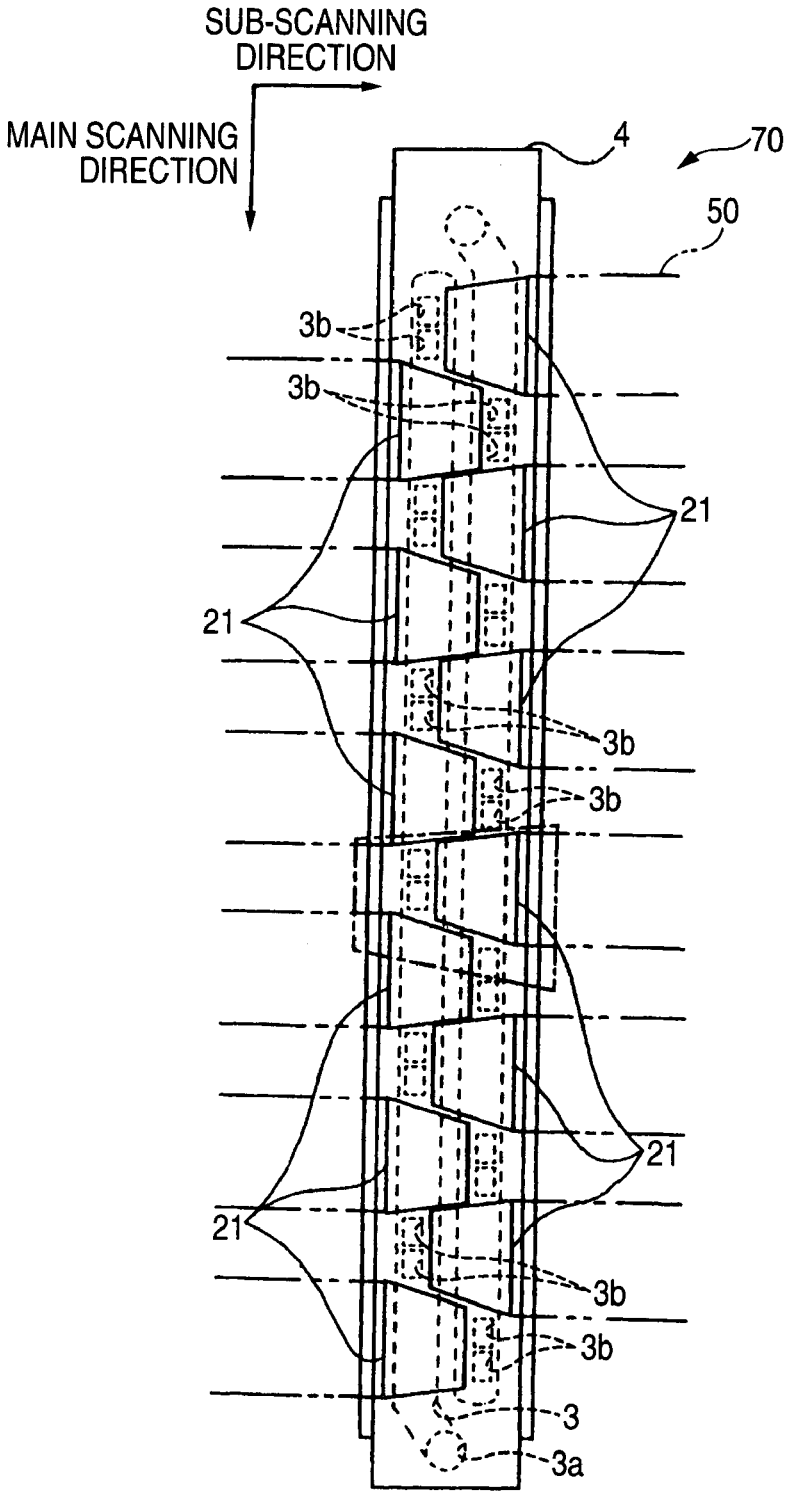
FIG. 4 is a plan view of a head main body included in the ink-jet head shown in FIG. 2.

FIG. 4 is a plan view of the head main body included in the ink-jet head shown in FIG. 2. In FIG. 4, the ink reservoirs 3 formed in the base block 71 are imaginarily shown by broken lines. The FPCs 50 fixed to the actuator units 21 are shown by two-dot chain lines. The two ink reservoirs 3 extend in parallel to each other in the longitudinal direction of the head main body 70 and spaced from each other by a predetermined interval. Each of the two ink reservoirs 3 has an opening 3*a* at one end, and communicates with an ink tank (not shown) through this opening 3*a*, so that it is always filled with ink. The many openings 3*b* are provided in the respective ink reservoirs 3 in the longitudinal direction of the head main body 70, and connect the respective ink reservoirs 3 and the flow path unit 4 as described above. The many openings 3*b* include pairs and the two openings of each of the pairs are disposed to be close to each other in the longitudinal direction of the head main body 70. The pairs of the openings 3*b* communicating with the one ink reservoir 3 and the pairs of the openings 3*b* communicating with the other ink reservoir 3 are arranged in a staggered manner.

In the areas where the openings 3*b* are not disposed, the plural actuator units 21 having trapezoidal plane shapes are arranged in a staggered manner and in a pattern opposite to the pairs of the openings 3*b*. Parallel opposite sides (upper side and lower side) of each of the actuator units 21 are parallel to the longitudinal direction of the head main body 70. Parts of oblique sides of the adjacent actuator units 21 overlap with each other in a width direction of the head main body 70.

As shown in FIG. 4, one end part of the FPC 50 disposed on the upper surface of the actuator unit 21 is made to have substantially the same shape as the plane shape of the actuator unit 21, and as described later, land parts 37 of plural individual electrodes 35 arranged on the upper surface of the actuator unit 21 and contacts 66 of signal lines formed on the FPC 50 are bonded to each other, and the FPCs are led out in parallel to each other from the actuator units 21 in the short side direction (width direction) of the flow path unit 4, and are led out alternately in opposite directions to each other in the longitudinal direction of the flow path unit 4.

Figure 5:
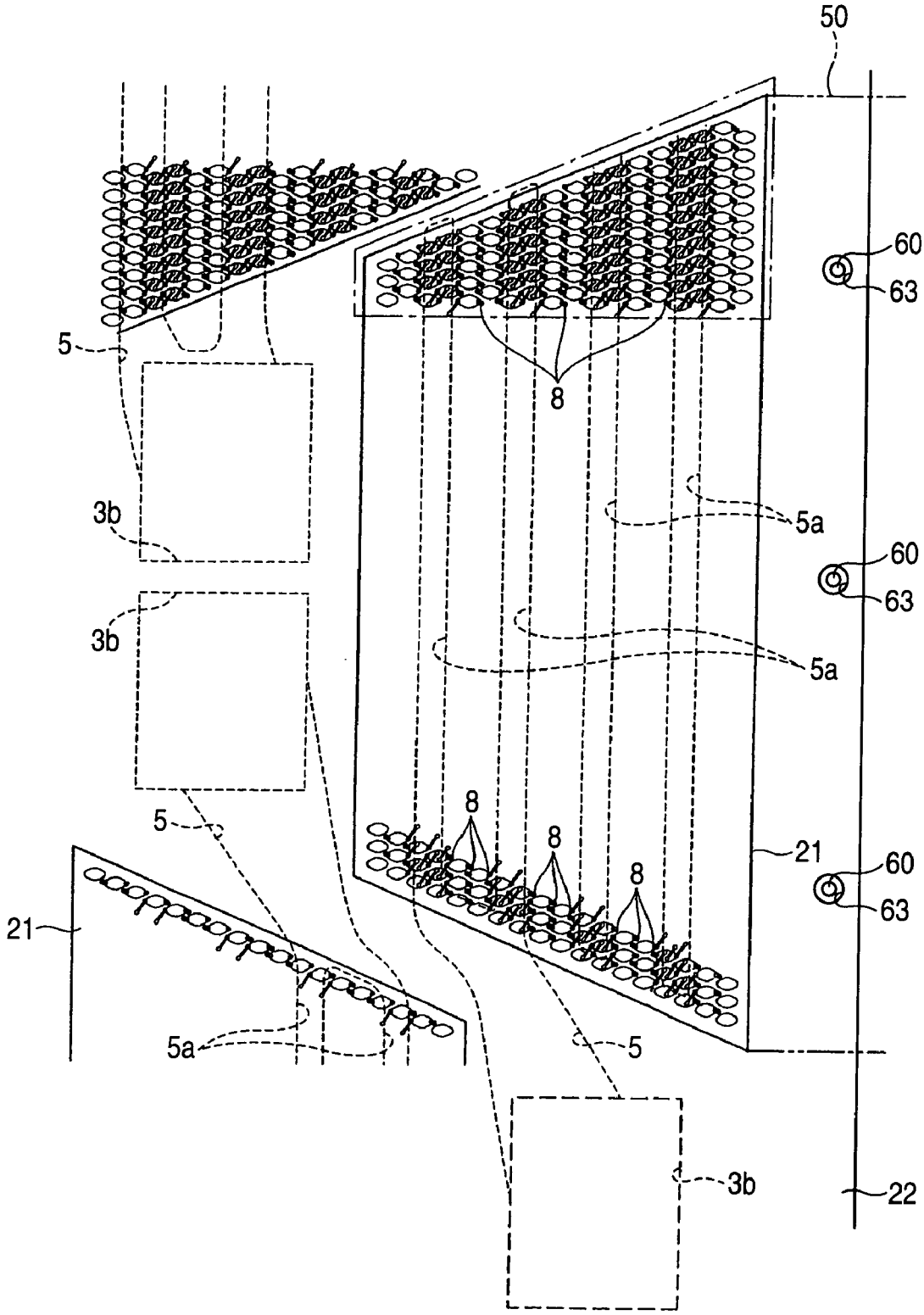
FIG. 5 is an enlarged view of an area surrounded by a one-dot chain line shown in FIG. 4.

FIG. 5 is an enlarged view of an area surrounded by a one-dot chain line drawn in FIG. 4. As shown in FIG. 5, the openings 3*b* provided in the ink reservoir 3 communicate with manifolds 5 as common ink chambers, and a tip end of each of the manifolds 5 branches into two and forms sub-manifolds 5*a*. Besides, when viewed on a plane, the two sub-manifolds 5*a* branching from the adjacent opening 3*b* extend from each of the two oblique sides of the actuator unit 21. That is, under the actuator unit 21, the four sub-manifolds 5*a* separate from each other extend along the parallel opposite sides of the actuator unit 21.

The lower surface of the flow path unit 4 corresponding to the adhesion area of the actuator unit 21 is an ink discharge area. Many nozzles 8 are arranged in a matrix form on the surface of the ink discharge area as described later. For the purpose of simplifying the drawing, only some nozzles 8 are shown in FIG. 5, however, they are actually disposed all over the ink discharge area.

Figure 6:
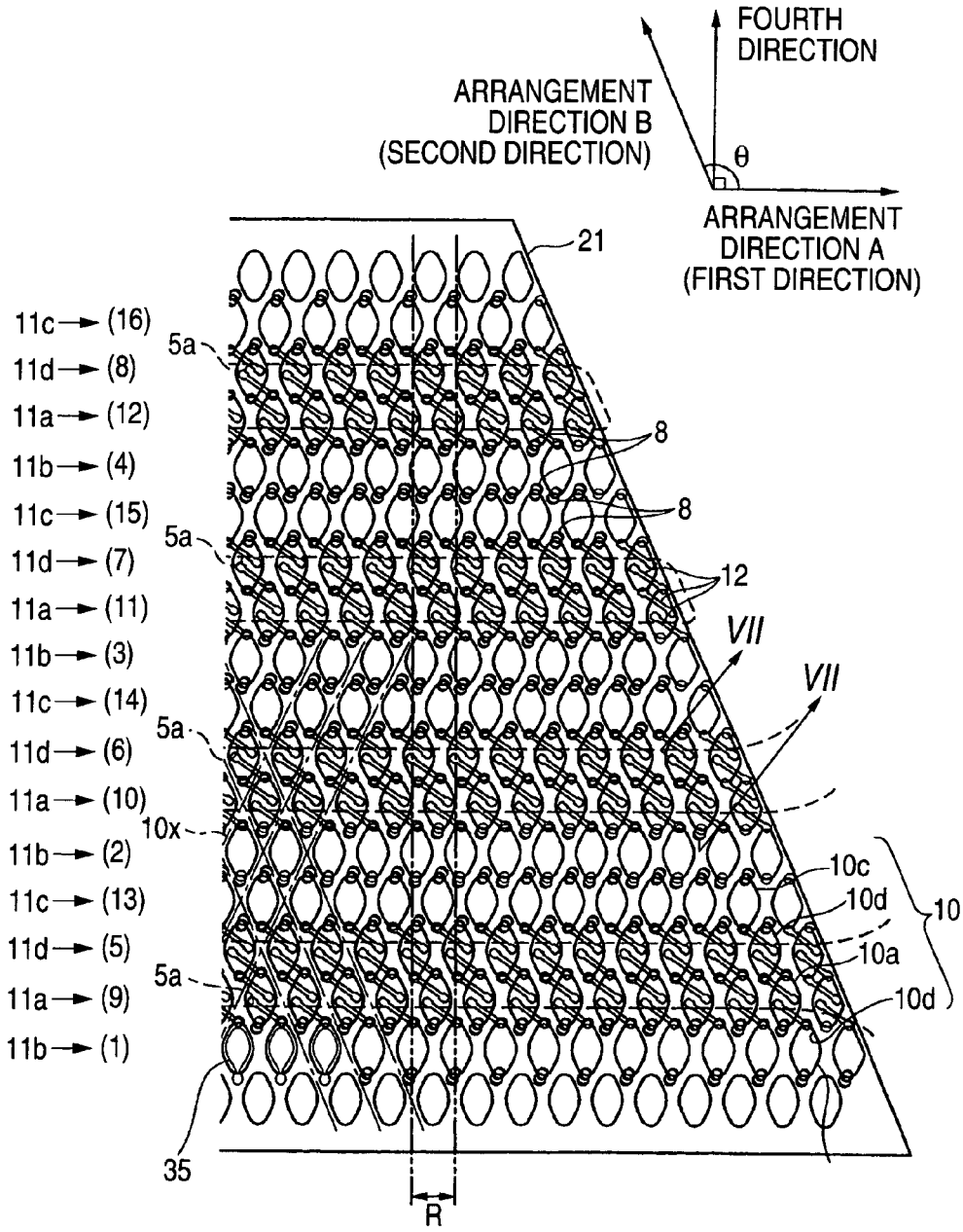
FIG. 6 is an enlarged view of an area surrounded by a one-dot chain line shown in FIG. 5.

FIG. 6 is an enlarged view of an area surrounded by a one-dot chain line shown in FIG. 5. FIGS. 5 and 6 show a state in which a plane on which many pressure chambers 10 in the flow path unit 4 are arranged in a matrix form is seen in a direction vertical to the ink discharge surface. Each of the pressure chambers 10 includes a plane shape of a parallelogram in which radius is given to each corner part, and a longer diagonal line is parallel to the width direction of the flow path unit 4. One end of each of the pressure chambers 10 communicates with the nozzle 8, and the other end communicates with the sub-manifold 5*a* as the common ink plow path through an aperture 12. When viewed on a plane, at a position overlapping with each of the pressure chambers 10, the individual electrode 35 having a plane shape similar to the pressure chamber 10 and one size smaller than this is formed on the actuator unit 21, and an individual electrode group of the plural individual electrodes 35 is constructed on the actuator unit 21. FIG. 6 shows only some of the many individual electrodes 35 to simplify the drawing. Incidentally, in FIGS. 5 and 6, for the purpose of making the drawing plain, the pressure chambers 10, the apertures 12 and the like which exist in the actuator unit 21 or the flow path unit 4 and should be drawn by broken lines, are drawn by solid lines.

In FIG. 6, plural imaginary rhombic areas 10*x* in each of which the pressure chamber 10 is contained are adjacently arranged in a matrix form in two directions, that is, arrangement direction A (first direction) and arrangement direction B (second direction) so that they do not overlap with one another and have the respective sides in common. The arrangement direction A is the longitudinal direction of the ink-jet head 1, that is, the extension direction of the sub-manifold 5*a*, and is parallel to a short diagonal line of the rhombic area 10*x*. The arrangement direction B is a direction of one oblique line of the rhombic area 10*x* forming an obtuse angle with respect to the arrangement direction A. The pressure chamber 10 and the corresponding rhombic area 10*x* share the center position, and border lines of both are separate from each other when viewed on a plane.

The pressure chambers 10 adjacently arranged in a matrix form in the two directions of the arrangement direction A and the arrangement direction B are separate from each other by a distance equivalent to 37.5 dpi in the arrangement direction A. Besides, in one ink discharge area, 16 pressure chambers 10 are disposed in the arrangement direction B. The pressure chambers at both ends in the arrangement direction B are dummy, and do not contribute to ink discharge.

The pressure chamber group constituted by the plural pressure chambers 10 disposed in a matrix form has substantially the same similar shape as the plane shape of the actuator unit 21. The plural pressure chambers 10 form plural pressure chamber lines in the arrangement direction A shown in FIG. 6. The pressure chamber lines are classified into a first pressure chamber line 11*a*, a second pressure chamber line 11*b*, a third pressure chamber line 11*c*, and a fourth pressure chamber line 11*d* according to the relative position to the sub-manifold 5*a* when viewed in a direction (third direction) vertical to the paper surface of FIG. 6. These first to fourth pressure chamber lines 11*a* to 11*d* are periodically arranged by fours in sequence of 11*c*→11*d*→11*a*→11*b*→11*c*→11*d*→ . . . →11*b* from the upper side of the actuator unit 21 to the lower side.

In pressure chambers 10*a* constituting the first pressure chamber line 11*a* and pressure chambers 10*b* constituting the second pressure chamber line 11*b*, when viewed in the third direction, with respect to a direction (fourth direction) orthogonal to the arrangement direction A, the nozzles 8 are unevenly distributed on the lower side of the paper surface of FIG. 5. The nozzles 8 are respectively positioned at the lower ends of the corresponding rhombic areas 10*x*. On the other hand, in pressure chambers 10*c* constituting the third pressure chamber line 11*c* and pressure chambers 10*d* constituting the fourth pressure chamber line 11*d*, with respect to the fourth direction, the nozzles 8 are unevenly distributed on the upper side of the paper surface of FIG. 5. The nozzles 8 are respectively positioned at the upper ends of the corresponding rhombic areas 10*x*. In the first and the fourth pressure chamber lines 11*a* and 11*d*, when viewed in the third direction, half or more of the pressure chambers 10*a* and 10*d* overlap with the sub-manifold 5*a*. In the second and the third pressure chamber lines 11*b* and 11*c*, when viewed in the third direction, all areas of the pressure chambers 10*b* and 10*c* do not overlap with the sub-manifold 5*a*. Thus, with respect to the pressure chamber 10 belonging to any pressure chamber line, while the nozzle 8 communicating with this is made not to overlap with the sub-manifold 5*a*, the width of the sub-manifold 5*a* is made as wide as possible, and ink can be smoothly supplied to the respective pressure chambers 10.

Figure 7:
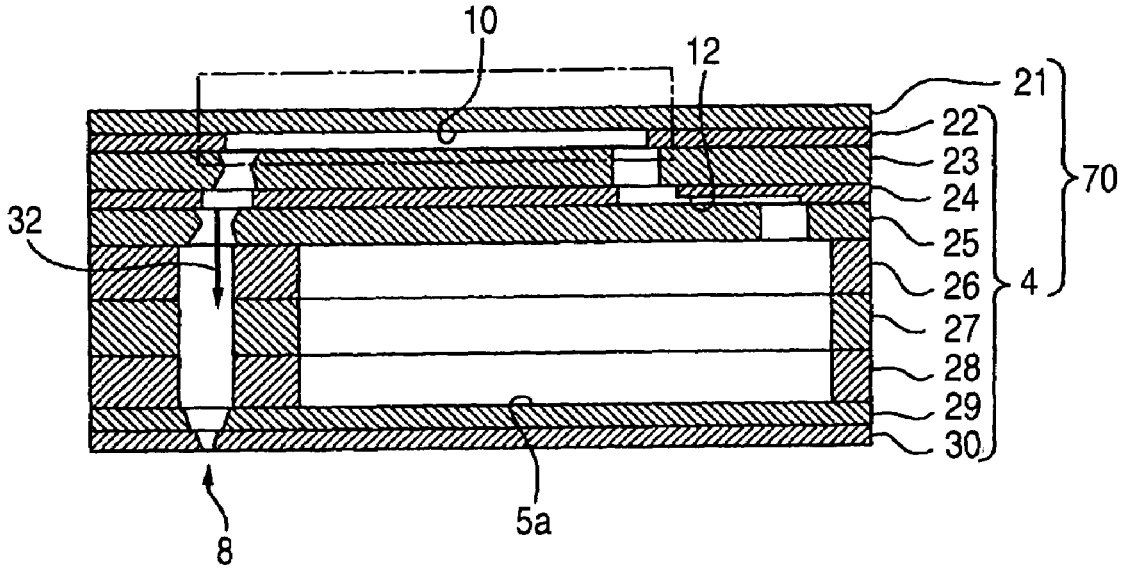
FIG. 7 is a sectional view taken along line VI—VI of FIG. 6.

Next, a sectional structure of the head main body 70 will be further described with reference to FIGS. 7 and 8. FIG. 7 is a sectional view taken along line VI—VI of FIG. 6, and FIG. 7 shows the pressure chamber 10*a* belonging to the first pressure chamber line 11*a*. As is understood from FIG. 7, each of the nozzles 8 communicates with the sub-manifold 5*a* through the pressure chamber 10 (10*a*) and the aperture 12. In this way, an individual ink path 32 extending from an outlet of the sub-manifold 5*a* through the aperture 12 and the pressure chamber 10 to the nozzle 8 is formed in each of the pressure chambers 10.

As is apparent from FIG. 7, the pressure chamber 10 and the aperture 12 are provided at different levels. By this, as shown in FIG. 6, in the flow path unit 4 corresponding to the ink discharge area under the actuator unit 21, the aperture 12 communicating with one pressure chamber 10 can be arranged at the same position as the pressure chamber 10 adjacent to the one pressure chamber when viewed on a plane. As a result, since the pressure chambers 10 are arranged closely and at high density, high resolution image printing can be realized by the ink-jet head 1 having a relatively small occupied area.

Figure 8:
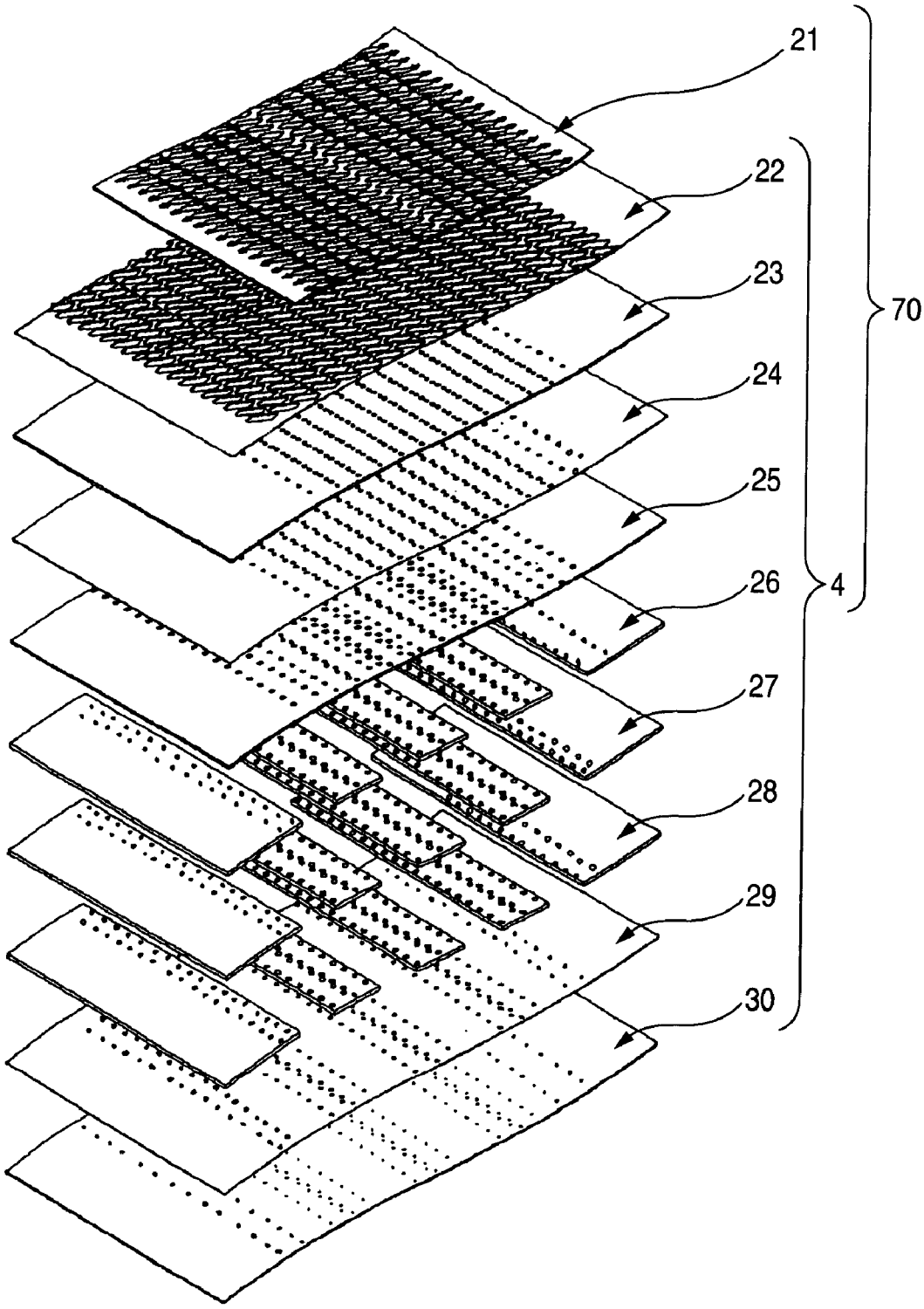
FIG. 8 is a partial exploded perspective view of a head main body shown in FIG. 7.

As is understood from FIG. 8, the head main body 70 has a lamination structure in which ten sheet-like members of an actuator unit 21, a cavity plate 22, abase plate 23, an aperture plate 24, a supply plate 25, manifold plates 26, 27 and 28, a cover plate 29 and a nozzle plate 30 from the top are laminated via adhesive. Among these, the nine plates except the actuator unit 21 constitute the flow path unit 4.

As described later, the actuator unit 21 is such that four piezoelectric sheets 41 to 44 (see FIG. 9) are laminated and an electrode is disposed so that only the uppermost layer thereof is a layer having a portion which becomes an active layer at the time of electric field application (hereinafter simply referred to as "a layer having an active layer"), and the three remaining layers are non-active layers. The cavity plate 22 is a metal plate in which many rhombic openings corresponding to the pressure chambers 10 are provided. The base plate 23 is a metal plate in which with respect to one of the pressure chambers 10 of the cavity plate 22, a communication hole between the pressure chamber 10 and the aperture 12 and a communication hole between the pressure chamber 10 and the nozzle 8 are provided. The aperture plate 24 is a metal plate in which with respect to one of the pressure chambers 10 of the cavity plate 22, in addition to the aperture 12, a communication hole from the pressure chamber 10 to the nozzle plate 8 is provided. The supply plate 25 is a metal plate in which with respect to one of the pressure chambers 10 of the cavity plate 22, a communication hole between the aperture 12 and the sub-manifold 5*a* and a communication hole from the pressure chamber 10 to the nozzle 8 are provided. The manifold plates 26, 27 and 28 are metal plates in which with respect to one of the pressure chambers 10 of the cavity plate 22, in addition to the sub-manifold 5*a*, communication holes from the pressure chamber 10 to the nozzle 8 are provided. The cover plate 29 is a metal plate in which with respect to one of the pressure chambers 10 of the cavity plate 22, a communication hole from the pressure chamber 10 to the nozzle plate 8 is provided. The nozzle plate 30 is a metal plate in which with respect to one of the pressure chambers 10 of the cavity plate 22, the nozzle 8 is provided.

These ten sheets 21 to 30 are positioned and laminated so that the individual ink path 32 as shown in FIG. 7 is formed. The individual ink flow path 32 first goes upward from the sub-manifold 5*a*, extends horizontally in the aperture 12, and then, further goes upward, extends again in the pressure chamber 10, slightly goes obliquely downward in a direction of moving away from the aperture 12, and goes vertically downward toward the nozzle 8.

Figure 9A:
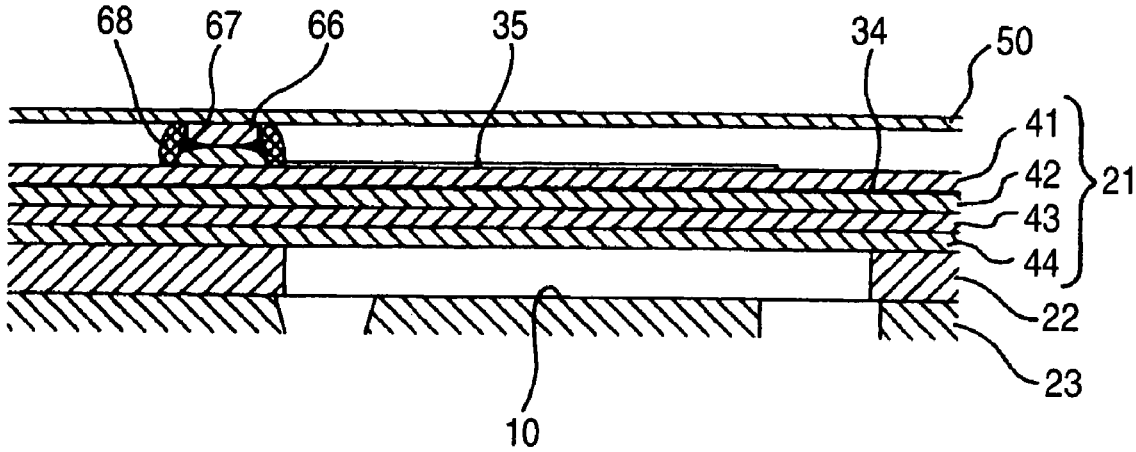
FIG. 9A is a sectional view showing a state where an individual electrode disposed on an actuator unit and an FPC are connected in an enlarged view of a portion surrounded by a one-dot chain line in FIG. 7.
Figure 9B:
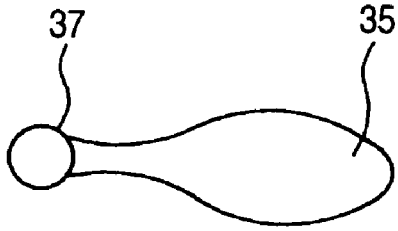
FIG. 9B is a plan view showing the shape of the individual electrode in an enlarged view of a portion surrounded by a one-dot chain line in FIG. 7.

FIGS. 9A and 9B are enlarged views of a portion surrounded by a one-dot chain line in FIG. 7, in which FIG. 9A is a sectional view showing a state where the individual electrode disposed on the actuator unit and the FPC are connected to each other, and FIG. 9B is a plan view showing the shape of the individual electrode. The actuator unit 21 shown in FIG. 9A includes the four piezoelectric sheets 41 to 44 each formed to have a same thickness of about 15.m. These piezoelectric sheets 41 to 44 are continuous laminar flat plates (continuous flat plate layers) arranged to extend over the many pressure chambers 10 formed in one ink discharge area of the head main body 70. The piezoelectric sheets 41 to 44 are arranged, as the continuous flat plate layers, to extend over the many pressure chambers 10, so that the individual electrodes 35 can be arranged on the piezoelectric sheet 41 at high density by using, for example, a screen printing technique. Thus, the pressure chambers 10 formed at positions corresponding to the individual electrodes 35 can also be arranged at high density, and printing of a high resolution image becomes possible. The piezoelectric sheets 41 to 44 are made of ceramic material of lead zirconate titanate (PZT) having ferroelectricity.

The individual electrode 35 is formed on the piezoelectric sheet 41 of the uppermost layer. A common electrode 34 formed on the whole surface of the sheet and having a thickness of about 2.m intervene between the piezoelectric sheet 41 of the uppermost layer and the lower piezoelectric sheet 42. An electrode is not disposed between the piezoelectric sheet 42 and the piezoelectric sheet 43 and between the piezoelectric sheet 43 and the piezoelectric sheet 44. Both the individual electrode 35 and the common electrode 34 are made of metal material such as Ag—Pd.

The individual electrode 35 has a thickness of approximately 1.m, and as shown in FIG. 9B, it has substantially a rhombic plane shape similar to the pressure chamber 10 as shown in FIG. 6. One of acute angle parts of substantially the rhombic individual electrode 35 is extended, and its end is provided with the circular land part 37 electrically connected to the individual electrode 35 and having a diameter of about 160.m. The land part 37 is made of, for example, gold containing glass frit.

The common electrode 34 is grounded in a not-shown area. By this, the common electrode 34 is equally kept at the ground potential in the areas corresponding to all the pressure chambers 10. Besides, as shown in FIG. 9A, with respect to the land part 37 of the individual electrode 35, a contact 66 of an independent signal line of the FPC 50 is bonded to the land part 37 of each of the individual electrodes 35, and the individual electrode 35 of the actuator unit 21 is connected to the driver IC 80 through the FPC 50, so that the potential of each of the individual electrodes 35 corresponding to the respective pressure chambers 10 can be controlled. With respect to the bonding of the contact 66 of the FPC 50 and the land part 37, a solder 67 is disposed in a portion where the contact 66 and the land part 37 are close to each other, and the signal line of the FPC 50 and the individual electrode 35 are electrically connected by the solder 67. An adhesive 68 is disposed at the outer periphery of the solder 67, and the FPC 50 and the actuator unit 21 are fixed.

In FIG. 5 again, at the lower side of the parallel opposite sides of the actuator unit 21, and on the side end edge part of the flow path unit 4 along the longitudinal direction (edge portion of the surface area of the flow path unit 4 not covered with the actuator unit 21), three adhesives 60, separate from each other, for bonding and fixing the FPC 50 to the flow path unit 4 are applied to each of the FPCs 50 in the longitudinal direction of the flow path unit 4. The height of the applied and bulged adhesive 60 is made to have substantially the same level as the lower surface of the FPC 50 which is led out to the outside of the ink-jet head 1 horizontally from the portion where the land part 37 of the individual electrode 35 and the contact 66 of the FPC 50 are bonded. Since the adhesive 60 is bulged to have such a height, the FPC 50 can be extended in parallel to the surface of the flow path unit 4 at the FPC 50 side. Accordingly, the adhesion between the FPC 50 and the flow path unit 4 becomes stable. Besides, in addition to the fixing of the contact 66 of the FPC 50 and the land part 37 of the individual electrode 35 by the adhesive 68, the FPC 50 and the flow path unit 4 are fixed by the adhesive 60, and therefore, even in the case where a force to peel off the bonding between the contact 66 of the FPC 50 and the land part 37 of the individual electrode 35 is applied to the FPC 50 from the outside, the FPC is not easily peeled off because of the adhesive 60. Thus, it is possible to restrain the electrical connection between the individual electrode 35 and the FPC 50 from being broken.

Although an epoxy adhesive (NCP: Non Conductive Paste) is used as the adhesive in this embodiment, another adhesive can be applied. The adhesive 68 to bond the contact 66 and the land part 37 also uses the same epoxy adhesive. Besides, as the adhesives 60 and 68, another kind of well-known adhesive can be applied.

Figure 10:
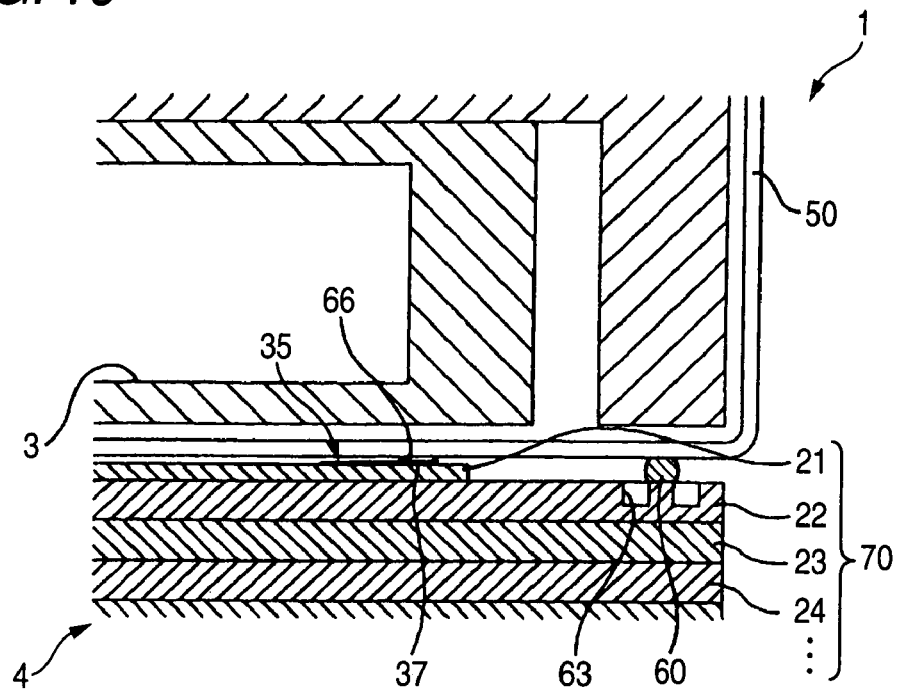
FIG. 10 is an enlarged view of an area surrounded by a one-dot chain line in FIG. 3.

FIG. 10 is an enlarged view of an area surrounded by a one-dot chain line in FIG. 3. As shown in FIG. 10, on the surface of the flow path unit 4 at the FPC 50 side and in the cavity plate 22, a recess (stepped part) 63 is formed by half-etching at the right and left of the adhesive 60 in the drawing. As shown in FIG. 5, the plain shape of the recess 63 is ring-shaped, and is formed to surround the adhesive 60. The recess 63 surrounds the adhesive 60 as stated above, so that when the FPC 50 and the flow path unit 4 are fixed to each other by a not-shown heating and pressurizing member for thermally setting the adhesive 60, it is possible to restrain the adhesive 60 from spreading on the surface of the flow path unit 4 since its viscosity is lowered before the adhesive 60 is thermally set. That is, a part of the adhesive 60 tending to spread due to the lowering of the viscosity is stored in the recess 63 and it is possible to restrain the adhesive 60 from adhering to the actuator unit 21. Thus, it is possible to prevent the occurrence of malfunction of the actuator unit 21 due to the adhesion of the adhesive 60 onto the actuator unit 21. Besides, it also becomes possible to prevent the adhesive 60 from running over from the surface of the flow path unit 4 at the FPC 50 side, and it is possible to prevent the adhesive 60 running over from the surface of the flow path unit 4 at the FPC 50 side from moving along the side surface of the flow path unit 4 to adhere to the bottom (ink discharge surface) of the flow path unit 4. Thus, since it is possible to prevent the adhesive 60 from adhering to the nozzle 8, the ink-jet head 1 can be obtained in which poor discharge of ink does not easily occur. Besides, since the recess 63 is merely formed at a part of the cavity plate 22 by half-etching, working becomes relatively simple.

Figure 17:
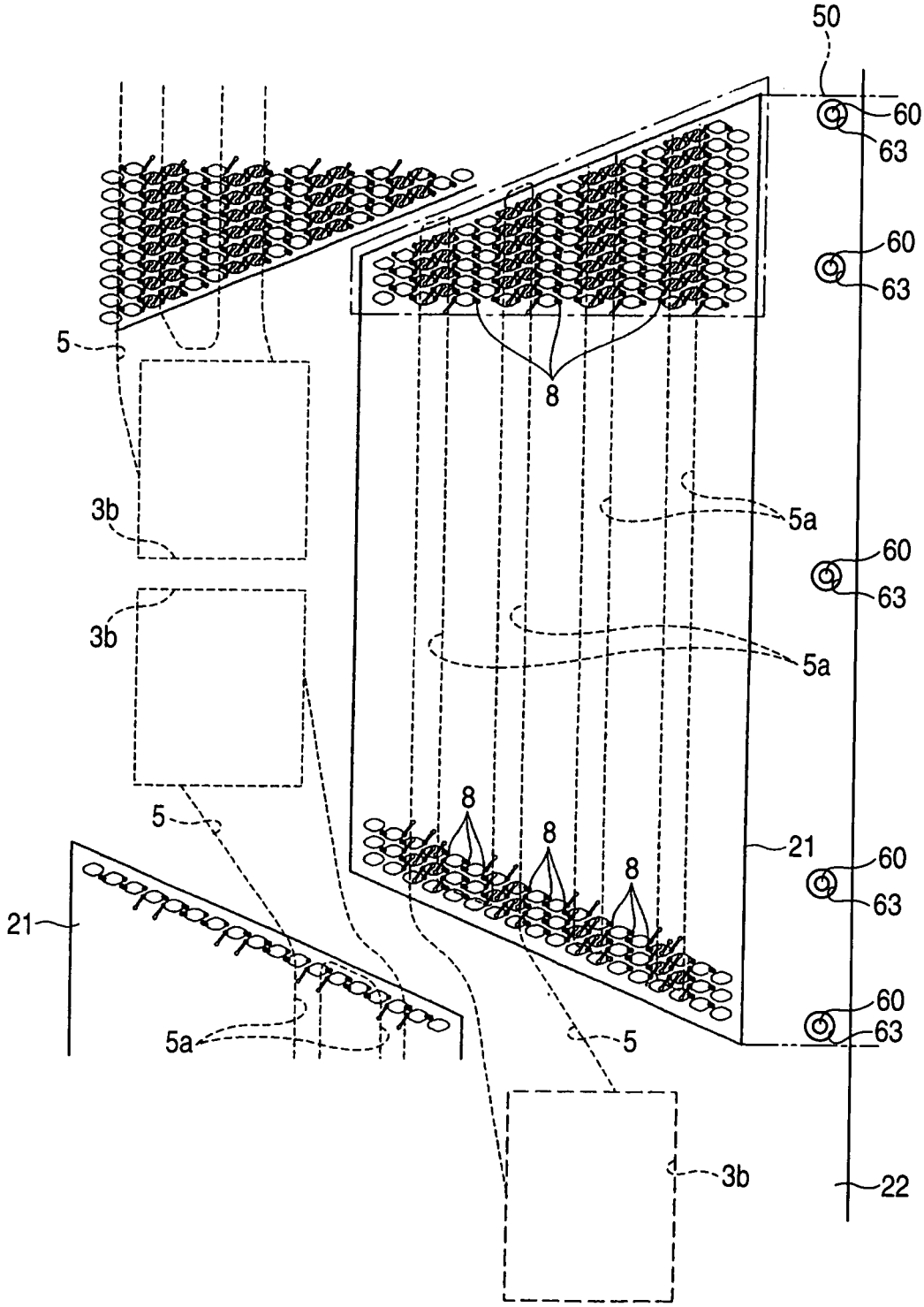
FIG. 17 is an enlarged view of an area surrounded by a one-dot chain line shown in FIG. 4, in which the adhesives 60 are applied to on one surface of the flow path unit opposed to both side end edges of the lower side of the parallel.

In addition to the adhesives shown in FIG. 5, as shown in FIG. 17, the adhesives 60 may be applied to on one surface of the flow path unit which is opposed to both side end edges of the lower side of the parallel, so that the adhesion between the FPC 50 and the flow path unit 4 becomes more stable.

Hereinafter, in another embodiments, the adhesives may be applied to on the one surface of the flow path unit which is opposed to both side end edges of the lower side of the parallel, so that the adhesion between the FPC 50 and the flow path unit 4 becomes more stable.

Next, the driving method of the actuator unit 21 will be described. The polarization direction of the piezoelectric sheet 41 in the actuator unit 21 is its thickness direction. That is, the actuator unit 21 has a so-called unimorph type structure in which the upper (that is, the side separate from the pressure chamber 10) one piezoelectric sheet 41 is made a layer in which an active layer exist, and the lower (that is, the side close to the pressure chamber 10) three piezoelectric sheets 42 to 44 are made non-active layers. Accordingly, when the individual electrode 35 is made to have a predetermined positive or negative potential, for example, when the electric field and the polarization are in the same direction, the electric field application portion sandwiched between the electrodes in the piezoelectric sheet 41 functions as the active layer (pressure generation part), and shrinks in the direction normal to the polarization direction according to a piezoelectric transverse effect. On the other hand, since the piezoelectric sheets 42 to 44 are not influenced by the electric field, they are not spontaneously varied, a difference occurs in distortion in a direction vertical to the polarization direction between the piezoelectric sheet 41 of the upper layer and the piezoelectric sheets 42 to 44 of the lower layers, and the whole of the piezoelectric sheets 41 to 44 are deformed to protrude toward the non-active side (unimorph deformation). At this time, as shown in FIG. 8, the lower surface of the piezoelectric sheets 41 to 44 is fixed to the upper surface of the separation wall (cavity plate) 22 for dividing the pressure chamber, eventually, the piezoelectric sheets 41 to 44 are deformed to protrude toward the pressure chamber side. Thus, the volume of the pressure chamber 10 is lowered, the pressure of ink is raised, and the ink is discharged from the nozzle 8. Thereafter, when the individual electrode 35 is returned to have the same potential as the common electrode 34, the piezoelectric sheets 41 to 44 are returned to have the original shape, and the volume of the pressure chamber 10 is returned to the original volume, and therefore, ink is sucked from the manifold 5 side.

As another driving method, the individual electrode 35 is previously made to have a potential different from the common electrode 34, the individual electrode 35 is once made to have the same potential as the common electrode 34 each time a discharge request is made, and the individual electrode 35 can be made again to have the potential different from the common electrode 34 at predetermined timing. In this case, the piezoelectric sheets 41 to 44 are returned to have the original shape at the timing when the individual electrode 35 and the common electrode 34 have the same potential, so that the volume of the pressure chamber 10 is increased as compared with the initial state (state where the potentials of both the electrodes are different from each other), and ink is sucked from the manifold 5 side into the pressure chamber 10. Thereafter, the piezoelectric sheets 41 to 44 are deformed to protrude toward the pressure chamber 10 side at the timing when the individual electrode 35 is made again to have the potential different from the common electrode 34, and the volume of the pressure chamber 10 is lowered, so that the pressure to the ink is raised, and the ink is discharged.

With reference to FIG. 5 again, a band-like area R having a width (678.0.m) equivalent to 37.5 dpi in the arrangement direction A and extending in the arrangement direction B will be considered. In the band-like area R, with respect to any line of the pressure chamber lines 11*a* to 11*d* of 16 lines, only one nozzle 8 exists. That is, in the case where the band-like area R as stated above is defined at an arbitrary position in the ink discharge area corresponding to one actuator unit 21, 16 nozzles 8 are always distributed in the band-like area R. Positions of points obtained by projecting the 16 nozzles 8 on a straight line extending in the arrangement direction A are spaced from each other by an interval equivalent to 600 dpi of the resolution at the time of printing.

When these 16 nozzles 8 are denoted by (1) to (16) in sequence from the left with respect to the positions obtained by projecting the 16 nozzles belonging to one band-like area R on the straight line extending in the arrangement direction A, these 16 nozzles 8 are arranged in sequence of (1), (9), (5), (13), (2), (10), (6), (14), (3), (11), (7), (15), (4), (12), (8), (16) from the bottom. In the ink-jet head 1 constructed as stated above, when the actuator unit 21 is suitably driven in accordance with the transport of a printing medium, a character or a figure having a resolution of 600 dpi can be drawn.

A description will be given to a case where for example, a straight line extending in the arrangement direction A is printed at a resolution of 600 dpi. First, a description will be given in brief to a case of a reference example in which the nozzle 8 communicates with an acute angle part of the pressure chamber 10 at the same side. In this case, in response to the transport of the printing medium, discharge of ink is started from the nozzles 8 in the pressure chamber line located at the lowermost position in FIG. 5, and the nozzles 8 belonging to the upper adjacent pressure chamber line are sequentially selected and ink is discharged. By this, dots of ink are formed adjacently at intervals of 600 dpi in the arrangement direction A. Finally, the straight line extending in the arrangement direction A is drawn at a resolution of 600 dpi.

On the other hand, in this embodiment, discharge of ink is started from the nozzles 8 in the pressure chamber line 11*b* located at the lowermost position in FIG. 5, and as the printing medium is transported, the nozzles 8 communicating with the upper adjacent pressure chamber are sequentially selected and ink is discharged. At this time, since displacement of position of the nozzle 8 in the arrangement direction A generated each time an upper pressure chamber line is selected from the lower side to the upper side is not the same, dots of ink sequentially formed in the arrangement direction A with the transport of the printing medium do not have equal intervals at intervals of 600 dpi.

That is, as shown in FIG. 5, in response to the transport of the printing medium, first, ink is discharged from the nozzles (1) communicating with the lowermost pressure chamber line 11*b* in the drawing, and a line of dots are formed at intervals corresponding to 37.5 dpi on the printing medium. Thereafter, the printing medium is transported and when the formation position of the straight line reaches the position of the nozzle (9) communicating with the second pressure chamber line 11*a* from the bottom, ink is discharged from this nozzle (9). By this, a second ink dot is formed at a position which is displaced by a distance eight times the interval equivalent to 600 dpi from the first formed dot position in the arrangement direction A.

Next, the printing medium is transported and when the formation position of the straight line reaches the position of the nozzle (5) communicating with the third pressure chamber line 11*d* from the bottom, ink is discharged from the nozzle (5). By this, a third ink dot is formed at the position which is displaced by a distance four times the interval equivalent to 600 dpi from the first formed dot position in the arrangement direction A. Further, the printing medium is transported and when the formation position of the straight line reaches the position of the nozzle (13) communicating with the fourth pressure chamber line 11*c* from the bottom, ink is discharged from the nozzle (13). By this, a fourth ink dot is formed at a position which is displaced by a distance 12 times the interval equivalent to 600 dpi from the first formed dot position in the arrangement direction A. Further, the printing medium is transported and when the formation position of the straight line reaches a position of the nozzle (2) communicating with the fifth pressure chamber line 11*b* from the bottom, ink is discharged from the nozzle (2). By this, a fifth ink dot is formed at a position which is displaced by an interval equivalent to 600 dpi from the first formed dot position in the arrangement direction A.

Similarly, in the following, while sequentially selecting the nozzle 8 communicating with the pressure chamber 10 positioned at an upper side from a lower side in the drawing, ink dots are formed. At this time, when the number of the nozzle 8 shown in FIG. 5 is N, an ink dot is formed at a position which is displaced by a distance equivalent to (magnification n=N−1)×(interval equivalent to 600 dpi) from the first formed dot position in the arrangement direction A. Finally, when the 16 nozzles 8 have been selected, adjacent ink dots formed at intervals equivalent to 37.5 dpi by the nozzles (1) in the lowermost pressure chamber line 11*b* in the drawing are connected by 15 dots formed to be separate from each other at intervals equivalent to 600 dpi, and it is possible to draw the straight line extending in the arrangement direction A at a resolution of 600 dpi in total.

Incidentally, in the vicinities of both ends (oblique sides of the actuator unit 21) of the ink discharge area in the arrangement direction A, a complementary relation is established with the vicinities of, in the arrangement direction A, both ends of the ink discharge area corresponding to the other opposite actuator unit 21 in the width direction of the head main body 70, so that printing at a resolution of 600 dpi becomes possible.

Figure 11:
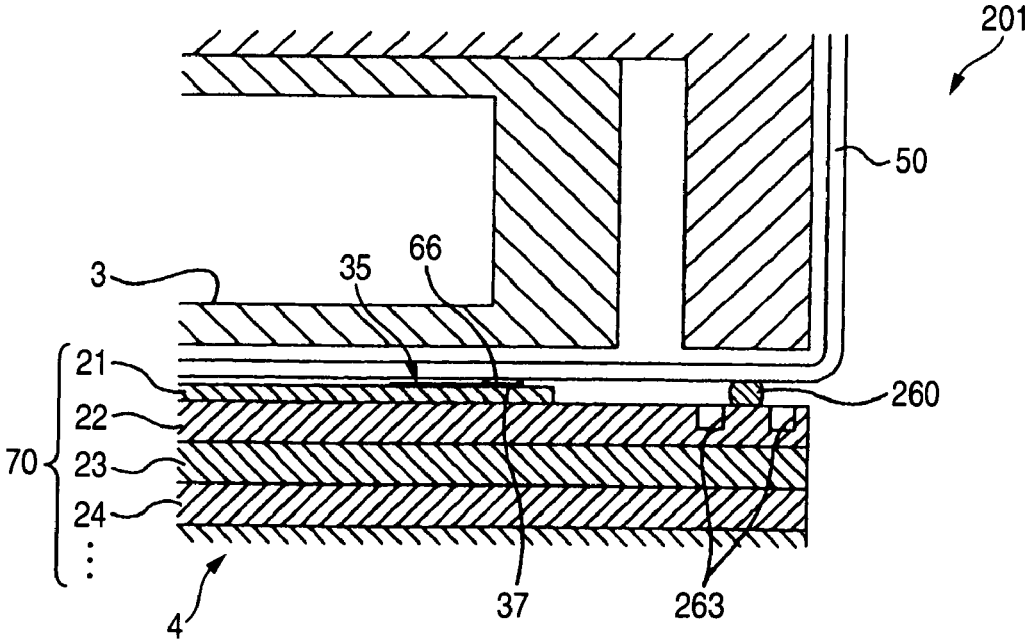
FIG. 11 is a main part enlarged view of an ink-jet head according to a second embodiment.
Figure 12:
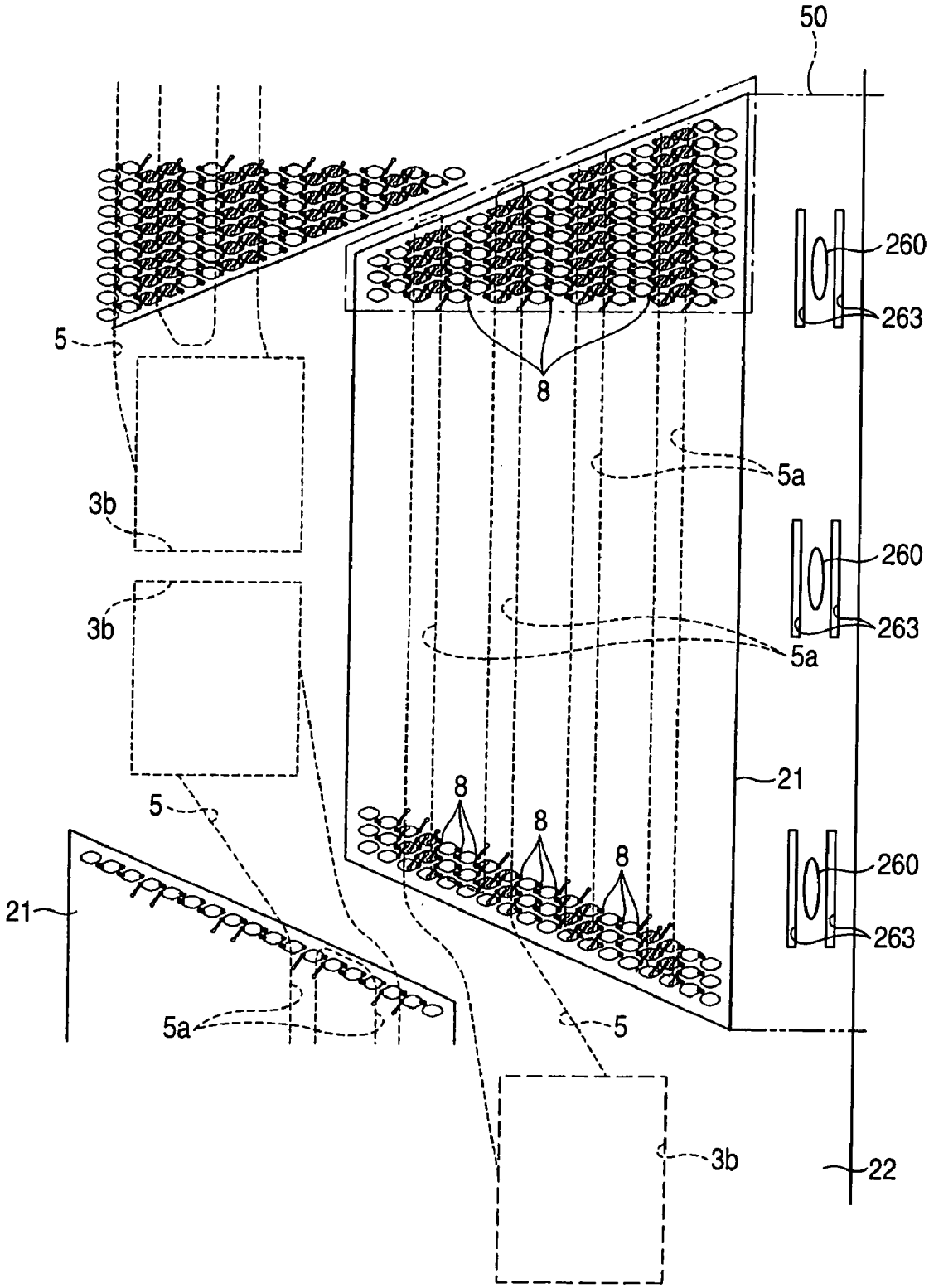
FIG. 12 is a main part plan view of a head main body included in the ink-jet head according to the second embodiment.

Next, an ink-jet head of a second embodiment will be described below. FIG. 11 is a main part enlarged view of the ink-jet head according to the second embodiment. FIG. 12 is a main part plan view of a head main body included in the ink-jet head according to the second embodiment. Incidentally, similar parts to those of the foregoing ink-jet head 1 are denoted by the same symbols and their explanation will be omitted.

An ink-jet head 201 shown in FIG. 11 is almost similar to the foregoing ink-jet head 1, and as shown in FIGS. 11 and 12, differences from the foregoing ink-jet head 1 are merely an application shape of an adhesive 260 for bonding an FPC 50 and a flow path unit 4 when viewed on a plane, and a shape of a recess 263, when viewed on a plane, for storing the adhesive 260 when viscosity of the adhesive 260 is lowered.

On the surface of the flow path unit 4 of the ink-jet head 201 at the FPC 50 side and at the side end of the flow path unit 4 along the longitudinal direction, as shown in FIG. 12, three elliptical adhesives 260 are applied to be spaced from each other in the longitudinal direction of the flow path unit 4 for each of the FPCs 50. Since the adhesive 260 is applied as stated above, the application area of the adhesive 260 becomes larger than the application area of the adhesive 60 for fixing the FPC 50 and the flow path unit 4 in the ink-jet head 1, and the fixing force for bonding and fixing the FPC 50 and the flow path unit 4 becomes large, and therefore, even in the case where a force to peel off the bonding between the contact 66 of the FPC 50 and the land part 37 of the individual electrode 35 is applied to the FPC 50 from the outside, the FPC 50 is not easily peeled off because of the adhesive 260. Thus, it is possible to effectively restrain electrical connection between the individual electrode 35 and the FPC 50 from being broken.

In a cavity plate 22 of the ink-jet head 201, as shown in FIG. 11, a recess (stepped part) 263 is formed by half-etching at each of the right and left of each of the adhesives in the drawing. As shown in FIG. 12, the length of the recess 263 in the longitudinal direction of the flow path unit 4 is formed to be slightly longer than the length of the adjacent adhesive 260 in the longitudinal direction of the flow path unit 4. Since the recess 263 is formed as stated above, when the FPC 50 and the flow path unit 4 are fixed by a not-shown heating and pressurizing member for thermally setting the adhesive 260 similarly to the above, a part of the adhesive 260 spreading on the surface of the flow path unit 4 due to the lowering of the viscosity before thermal setting of the adhesive 260 is stored in the recess 263 and it is possible to restrain the adhesive 260 from adhering to the actuator unit 21. Thus, it is possible to prevent malfunction of the actuator unit 21 due to the adhesion of the adhesive 260 onto the actuator unit 21 from occurring.

Figure 13:
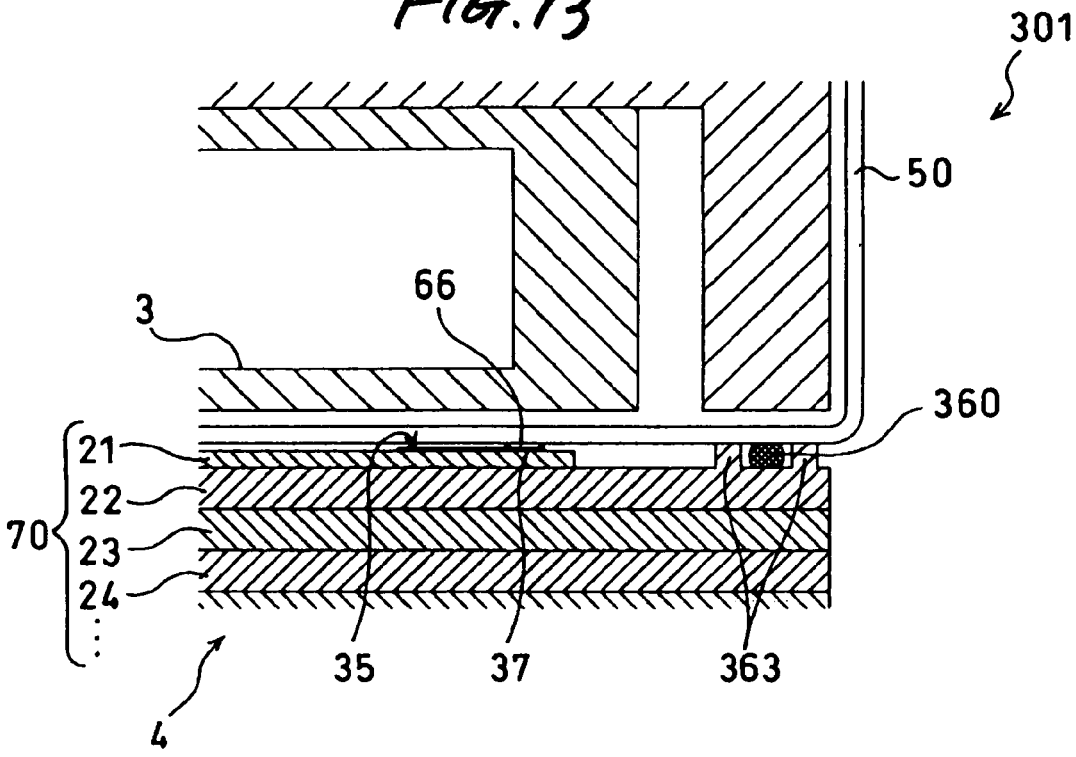
FIG. 13 is a main part enlarged view of an ink-jet head according to a third embodiment.
Figure 14:
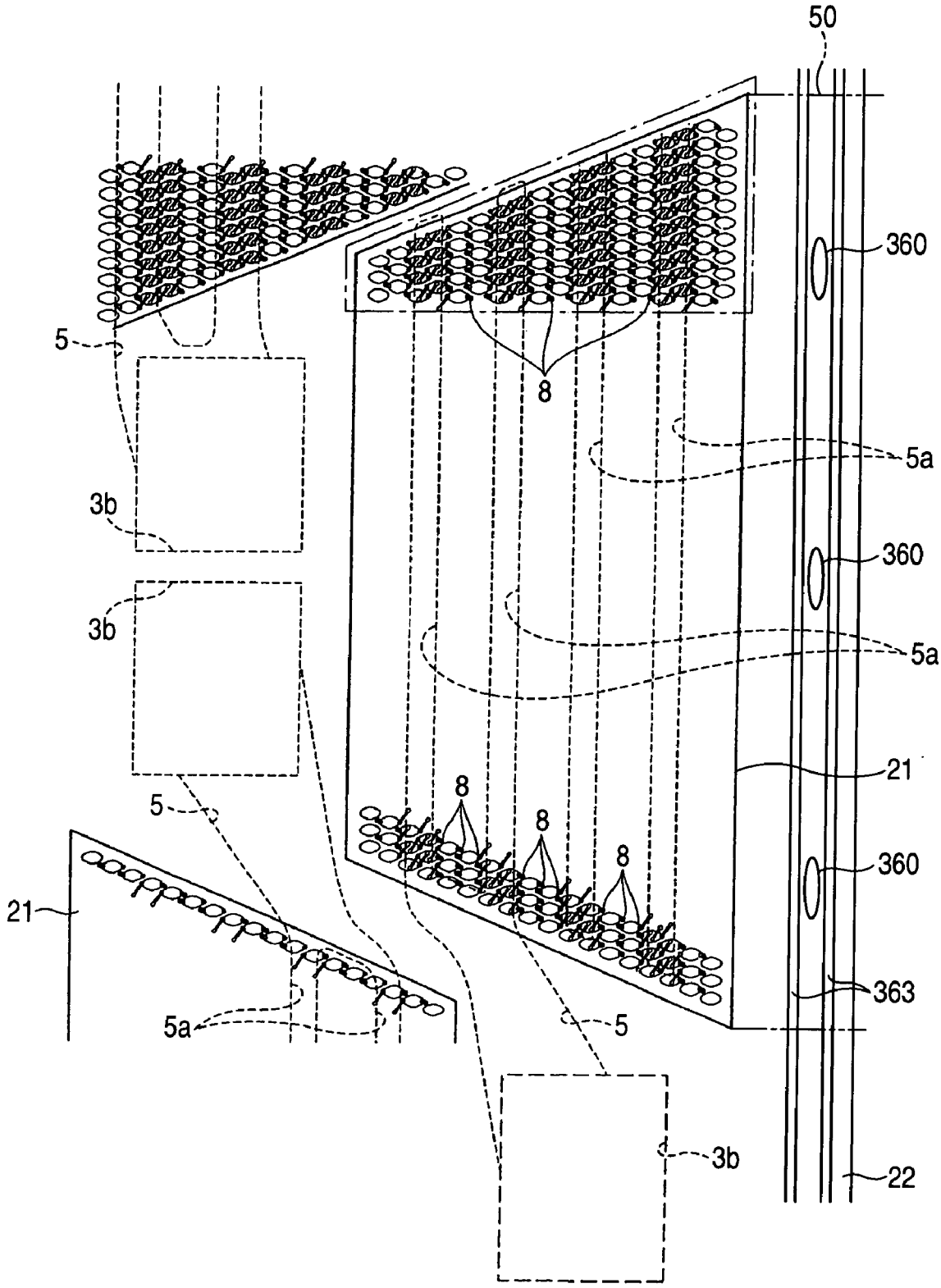
FIG. 14 is a main part plan view of a head main body included in the ink-jet head according to the third embodiment.

Next, an ink-jet head of a third embodiment will be described below. FIG. 13 is a main part enlarged view of the ink-jet head according to the third embodiment. FIG. 14 is a main part plan view of a head main body included in the ink-jet head according to the third embodiment. Incidentally, similar parts to those of the foregoing ink-jet head 1, 201 are denoted by the same symbols and their explanation will be omitted.

An ink-jet head 301 shown in FIG. 13 is almost similar to the ink-jet head 201, and is different from the ink-jet head 201 only in that as shown in FIGS. 13 and 14, walls 363 (as protrusions) are formed which prevent an adhesive 360 from spreading toward an actuator unit 21 side when viscosity of the adhesive 360 for bonding an FPC 50 and a flow path unit 4 is lowered.

Since the adhesive 360 is applied to the surface of the flow path unit 4 of the ink-jet head 301 at the FPC 50 side similarly to the adhesive 260 of the ink-jet head 201, there is obtained a similar effect to the foregoing ink-jet head 201. On a cavity plate 22 of the ink-jet head 301, as shown in FIG. 13, the wall (stepped part) 363 protruding toward the FPC 50 is formed at each of the right and left of each of the adhesives 360 in the drawing. The height (protruding amount from the cavity plate 22) of the wall 363 is made almost equal to the height level of the adhesive 360. Besides, a land part 37 of an individual electrode 35 and a contact 66 of the FPC 50 are bonded, the FPC 50 is led out to the outside of the ink-jet head 301 horizontally from that, and the position of the upper surface of the wall 363 is made to have substantially the same level as the lower surface of the FPC 50. As shown in FIG. 14, the wall 363 is continuously formed along the side end in the longitudinal direction of the flow path unit 4. Since the wall 363 is formed as stated above, when the FPC 50 and the flow path unit 4 are fixed by a not-shown heating and pressurizing member for thermally setting the adhesive 360, even if viscosity is lowered before the adhesive 360 is thermally set and the adhesive spreads on the surface of the flow path unit 4, the flow of the adhesive 360 is stopped by the wall 363, and it is possible to restrain the adhesive 360 from flowing on the actuator unit 21 and adhering to it. Thus, it is possible to prevent the occurrence of malfunction of the actuator unit 21 due to the adhesion of the adhesive 360 onto the actuator unit 21. Besides, the height of the wall 363 is made substantially coincident with the distance between the flow path unit 4 and the FPC 50 at the individual electrode 35, so that the wall 363 supports the FPC 50, and therefore, bonding between the FPC 50 and the flow path unit 4 by the adhesive 360 becomes very stable.

Figure 15:
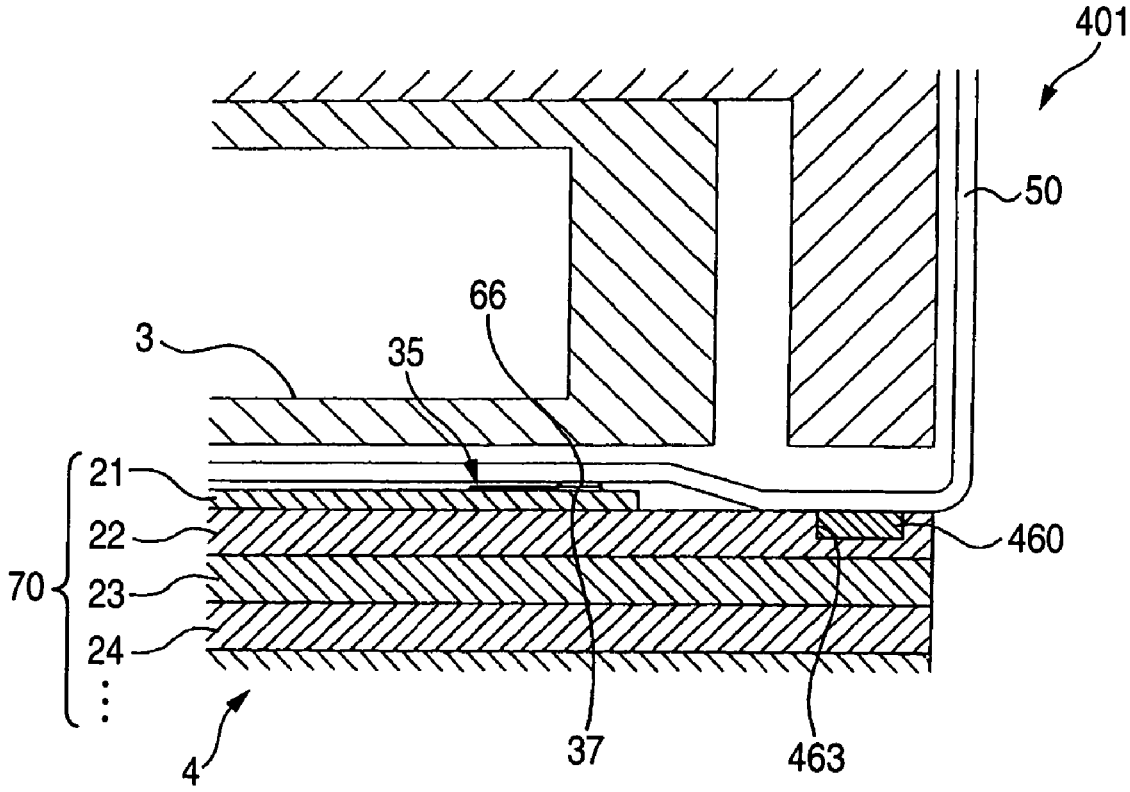
FIG. 15 is a main part enlarged view of an ink-jet head according to a fourth embodiment.
Figure 16:
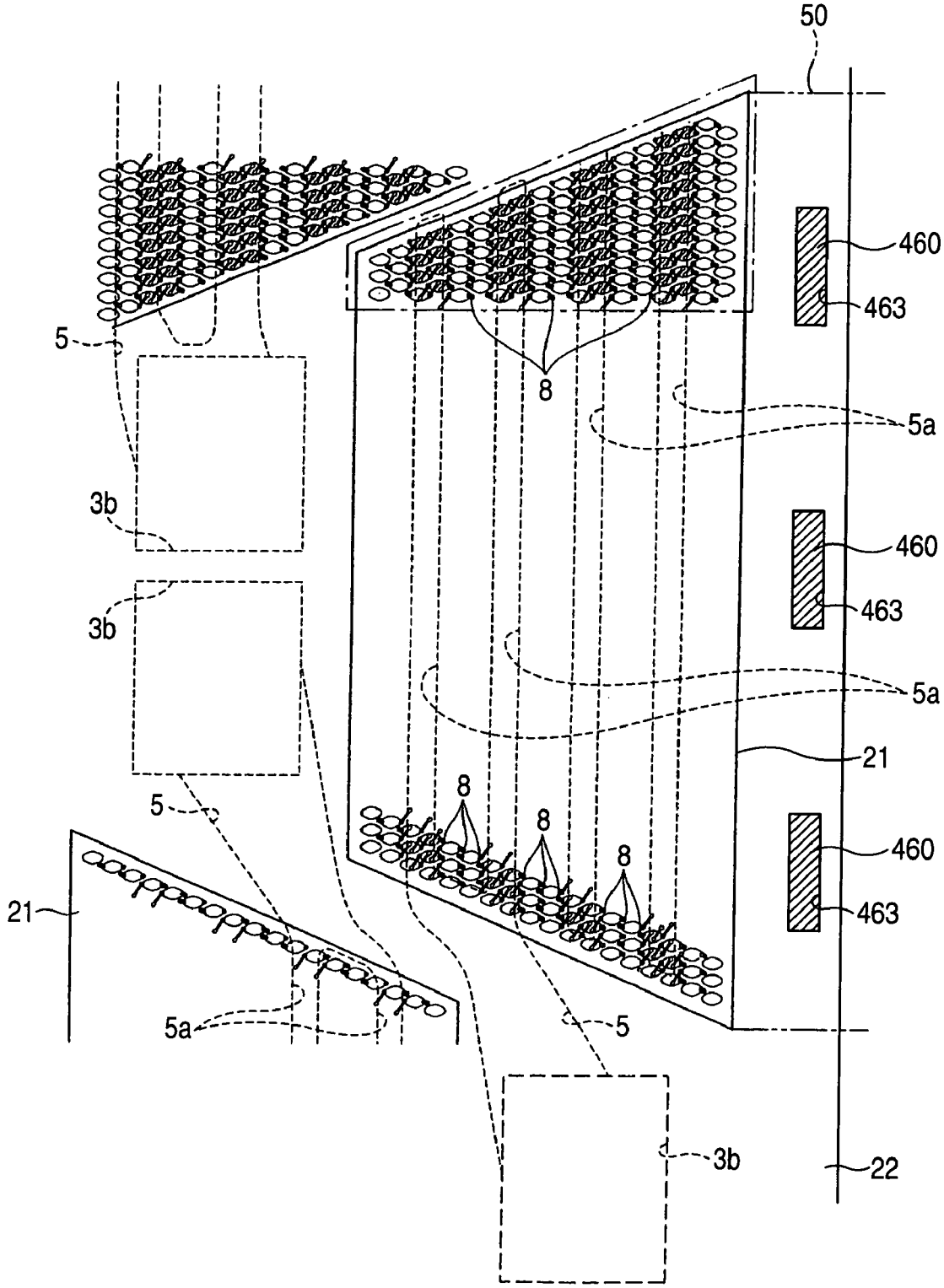
FIG. 16 is a main part plan view of a head main body included in the ink-jet head according to the fourth embodiment.

Next, an ink-jet head of a fourth embodiment will be described below. FIG. 15 is a main part enlarged view of the ink-jet head according to the fourth embodiment. FIG. 16 is a main part plan view of a head main body included in the ink-jet head according to the fourth embodiment. Incidentally, similar parts to those of the foregoing ink-jet head 1 are denoted by the same symbols and their explanation will be omitted.

An ink-jet head 401 shown in FIG. 15 is substantially the same as the foregoing ink-jet head 1, and as shown in FIGS.

15 and 16, a difference from the ink-jet head 1 is merely such that an adhesive 460 for bonding an FPC 50 and a flow path unit 4 is stored in a recess 463 formed in a surface of the flow path unit 4 at the side of the FPC 50.

On the surface of the flow path unit 4 of the ink-jet head 401 at the FPC 50 side, the recess (stepped part) 463 for storing the adhesive 460 is formed at a side end of the flow path unit 4 along the longitudinal direction. As shown in FIG. 16, the recess 463 has a rectangular plane shape, and three recesses are formed for each of the FPCs 50 in the longitudinal direction of the flow path unit 4. Besides, the recesses 463 are separate from each other. The adhesive 460 for bonding the FPC 50 and the flow path unit 4 is stored in the recess part 463 to such a degree that it does not flow out. When the FPC 50 is bonded to the flow path unit 4, a not-shown heating and pressurizing member with a stepped part is used to press the FPC 50 to the flow path unit 4 from above and to heat it, so that bonding and fixing is performed. Accordingly, as shown in FIG. 15 as well, the FPC 50 is slightly bent from one corner portion of the actuator unit 21 to the vicinity of the adhesive 460.

Since the recess 463 as stated above is formed and the adhesive 460 is stored in the recess 463, when the FPC 50 is fixed to the flow path unit 4, even if viscosity is lowered before the adhesive 460 is thermally set, it does not flow out onto the surface of the flow path unit 4 at the FPC 50 side. Thus, similarly to the above, it is possible to prevent the occurrence of malfunction of the actuator unit 21 due to the adhesion of the adhesive 460 onto the actuator unit 21. Besides, since the recess 463 is merely formed in the relatively small area of the cavity plate 22, working becomes relatively easy.

According to the ink-jet heads 1, 201, 301 and 401 of the respective embodiments, since the FPC 50 is fixed to the flow path unit 4 with not only the individual electrodes 35 but also the adhesives 60, 260, 360 and 460, even if a force is applied the FPC 50 from the outside to peel off this, the FPC 50 is not easily peeled off. Thus, it is possible to restrain electrical connection between the individual electrode 35 and the FPC 50 from being broken. Besides, since the recess 63, 263, 463 or the wall 363 to produce the stepped part exists between the actuator unit and the adhesive 60, 260, 460 for bonding the FPC 50 and the flow path unit 4, it is possible to restrain the adhesive 60, 260, 360, 460 from flowing to the actuator unit 21 side because of lowering of viscosity. Accordingly, it is possible to prevent the occurrence of malfunction of the actuator unit 21 due to the adhesion of the adhesive 60, 260, 360, 460, and the ink-jet head 1, 201, 301, 401 can be obtained in which poor discharge of ink from the nozzle 8 does not easily occur. Besides, in the ink-jet printer including the foregoing ink-jet head 1, 201, 301, 401, since the malfunction of the actuator unit 21 of the ink-jet head 1, 201, 301, 401 does not easily occur, the ink-jet printer in which printing quality is improved can be obtained.

Although the preferred embodiments of the invention have been described, the invention is not limited to the foregoing embodiments, and various design modifications can be made within the scope of the claims. For example, although the ink-jet head 1 of the foregoing embodiment is a line-type one, a serial-type ink-jet head may be adopted. Besides, the ink-jet printer including the foregoing ink-jet head 1, 201, 301, 401 may include a printer main body of a mode different from the foregoing embodiment. The arrangement direction of the plural pressure chambers arranged in a matrix form along the surface of the flow path unit 4 is not limited to the arrangement directions A and B shown in FIG. 6 in the foregoing embodiments, and as long as it is along the surface of the flow path unit 4, various directions may be adopted. The area in which the pressure chamber 10 is contained may have various shapes such as a parallelogram, not the rhombic shape, and the plane shape of the pressure chamber 10 itself contained therein may be suitably modified to have another shape. The pressure chamber 10 and the sub-manifold 5*a* may be directly communicated with each other without the aperture 12. The flow path unit 4 may be one which is not lamination of plural sheet-like members.

The material of the piezoelectric sheet and the electrode in the actuator unit 21 is not limited to the foregoing, and may be changed to a different well-known material. An insulating sheet other than the piezoelectric sheet may be used as the non-active layer. The number of layers including the active layer, and the number of non-active layers may be suitably changed, and in accordance with the lamination number of the piezoelectric sheets, the number of individual electrodes and common electrodes may be suitably changed. In the foregoing embodiments, although the common electrode is kept at the ground potential, as long as the potential is common to the respective pressure chambers 10, it is not limited to this.

Besides, in the actuator unit 21 of the embodiment, although the non-active layer is arranged at the pressure chamber side of the layer including the active layer, the layer including active layer may be arranged at the pressure chamber 10 side of the non-active layer, or the non-active layer may not be provided. However, when the non-active layer is provided at the pressure chamber side of the layer including the active layer, it is expected that displacement efficiency of the actuator unit 21 is further improved.

In the above embodiments, as shown in FIG. 4, the two lines of plural trapezoidal actuator units 21 are arranged in a staggered manner, however, the actuator unit may not always be made trapezoidal, and plural actuator units may be disposed merely in one line in the longitudinal direction of the flow path unit. Alternatively, three or more lines of actuator units may be arranged in a staggered manner. Besides, instead of arranging one actuator unit over the plural pressure chambers 10, one actuator unit 21 may be disposed for each pressure chamber 10.

Many common electrode 34 may be formed for the respective pressure chambers 10 so that a projection area onto the lamination direction includes a pressure chamber area, or the projection area is contained in the pressure chamber area, and it is not always necessary that the common electrode is one conductive sheet provided in almost the whole area of one actuator unit 21. However, at this time, it is necessary that the common electrodes are electrically connected so that all portions corresponding to the pressure chambers 10 have the same potential. That is, plural common electrodes are individually formed in areas opposite to the individual electrodes and between the piezoelectric sheet 41 and the piezoelectric sheet 42, the common electrodes are connected with each other on the same plane, and one place of the common electrodes connected with each other may be grounded so that they have the same potential at the end of the actuator unit or the flow path unit. Besides, a through hole is formed in a part between the plural individual electrodes in parallel to the lamination direction of the actuator unit, and the connected common electrodes and the FPC 50 are coupled via the through hole and they may be set at the same potential.

Besides, the recesses 263 and the walls 363 of the ink-jet heads 201 and 301 of the second and the third embodiments may not exist at the side end along the longitudinal direction of the flow path unit, and they have only to be formed between the adhesive 260, 360 and the actuator unit 21. The recess 463 of the ink-jet head 401 of the fourth embodiment may be opened toward the side end along the longitudinal direction of the flow path unit 4. That is, the stepped part have only to be provided between the actuator unit 21 and the adhesive 260, 360, 460, and by doing so, it is possible to prevent the occurrence of malfunction of the actuator unit 21 due to adhesion of the adhesive 260, 360, 460 onto the actuator unit 21.

What is claimed is:

1. An ink-jet head comprising:

a flow path unit in which plural pressure chambers communicating with nozzles are arranged along a plane;

an actuator unit which includes plural individual electrodes arranged at positions opposite to the pressure chambers, is fixed to one surface of the flow path unit and changes volumes of the pressure chambers;

a flexible printed circuit in which plural signal lines for supplying drive signals to change volumes of the pressure chambers to the individual electrodes are formed as a conductive pattern and the respective signal lines are electrically connected to the corresponding individual electrodes;

an adhesive applied to an area not covered with the actuator unit on the one surface of the flow path unit and fixes the flexible printed circuit to the flow path unit; and a stepped part formed between the actuator unit and the adhesive on the one surface of the flow path unit so that movement of the adhesive in a direction of approaching the actuator unit is blocked.

2. An ink-jet head comprising:

a flow path unit in which plural pressure chambers communicating with nozzles are arranged along a plane;

an actuator unit which includes plural individual electrodes arranged at positions opposite to the pressure chambers, a common electrode provided to extend over the plural pressure chambers, and a piezoelectric sheet sandwiched between the common electrode and the individual electrodes, is fixed to one surface of the flow path unit and changes volumes of the pressure chambers;

a flexible printed circuit in which plural signal lines for supplying drive signals to change the volumes of the pressure chambers to the individual electrodes are formed as a conductive pattern and the respective signal lines are electrically connected to the corresponding individual electrodes;

an adhesive applied to an area not covered with the actuator unit on the one surface of the flow path unit and for fixing the flexible printed circuit to the flow path unit; and a stepped part formed between the actuator unit and the adhesive on the one surface of the flow path unit so that movement of the adhesive in a direction of approaching the actuator unit is blocked.

3. An ink-jet head according to claim 1, wherein the stepped part is a recess formed in an area of the one surface of the flow path unit where the adhesive is not applied.

4. An ink-jet head according to claim 1, wherein the stepped part is a protrusion formed in an area of the one surface of the flow path unit where the adhesive is not applied.

5. An ink-jet head according to claim 1, wherein the stepped part is formed to surround the adhesive.

6. An ink-jet head comprising:

a flow path unit in which plural pressure chambers communicating with nozzles are arranged along a plane;

an actuator unit which includes plural individual electrodes arranged at positions opposite to the pressure chambers, is fixed to one surface of the flow path unit and changes volumes of the pressure chambers;

a flexible printed circuit in which plural signal lines for supplying drive signals to change the volumes of the pressure chambers to the individual electrodes are formed as a conductive pattern and the respective signal lines are electrically connected to the corresponding individual electrodes; and an adhesive applied to an area not covered with the actuator unit on the one surface of the flow path unit and for fixing the flexible printed circuit to the flow path unit, wherein the flow path unit includes a stepped part which stores the adhesive in the area where the adhesive is applied.

7. An ink-jet head comprising:

a flow path unit in which plural pressure chambers communicating with nozzles are arranged along a plane;

an actuator unit which includes plural individual electrodes arranged at positions opposite to the pressure chambers, a common electrode provided to extend over the plural pressure chambers, and a piezoelectric sheet sandwiched between the common electrode and the individual electrodes, is fixed to one surface of the flow path unit and changes volumes of the pressure chambers;

a flexible printed circuit in which plural signal lines for supplying drive signals to change the volumes of the pressure chambers to the individual electrodes are formed as a conductive pattern and the respective signal lines are electrically connected to the corresponding individual electrodes; and an adhesive applied to an area not covered with the actuator unit on the one surface of the flow path unit and for fixing the flexible printed circuit to the flow path unit, wherein the flow path unit includes a stepped part for storing the adhesive in the area where the adhesive is applied.

8. An ink-jet recording apparatus including an ink-jet head according to claim 1, wherein the individual electrodes and the pressure chambers are arranged in a matrix form, and the stepped part is continuously or discretely provided along one side of a group of the individual electrodes arranged in the matrix form.

9. An ink-jet recording apparatus comprising:

an ink-jet head according to claim 1, in which the individual electrodes and the pressure chambers are arranged in a matrix form, and the stepped part is continuously or discretely provided at an edge part of the flow path unit in a direction intersecting with an extension direction of the flexible printed circuit.

10. An ink-jet head comprising:

a flow path unit having a rectangular outer shape in which trapezoidal pressure chamber groups, in each of which plural pressure chambers communicating with nozzles are adjacently arranged in a matrix form along a plane, are arranged in a staggered manner in a longitudinal direction while oblique sides of the pressure chamber groups overlap with each other in a width direction;

plural actuator units each of which includes plural individual electrodes arranged at positions opposite to the pressure chambers constituting the pressure chamber group, a common electrode provided to extend over the plural pressure chambers, and a piezoelectric sheet sandwiched between the common electrode and the individual electrodes, is fixed correspondingly to a formation area of each of the pressure chamber groups, has a similar shape to each of the pressure chamber groups and changes volumes of the pressure chambers;

flexible printed circuits in each of which signal lines for supplying drive signals to change the volumes of the pressure chambers to the individual electrodes in each of the actuator units are formed and the signal lines are electrically connected to the corresponding individual electrodes;

an adhesive applied to an area which is an end of the plane of the flow path unit in an extension direction in which the flexible printed circuit is led out and is not covered with the actuator unit, for fixing the flexible printed circuit to the flow path unit; and recesses formed between a position of the actuator unit and an application position of the adhesive to fix the flexible printed circuit and for blocking movement of the adhesive in a direction of approaching the actuator unit, wherein the flexible printed circuits correspond to the actuator units fixed to the flow path unit, and are led out alternately in opposite directions with respect to a longitudinal direction of the flow path unit, and at the end of the flow path unit in the extension direction in which the flexible printed circuit is led out, the plural recesses each formed to surround the adhesive are discretely provided in a direction intersecting with the extension direction.

11. An ink-jet head according to claim 1, wherein the stepped part is a protrusion which is protruded from the one face of the flow path unit to which the actuator unit is fixed, and the protruding portion has a same level of the actuator unit in height.

* * * * *